United States Patent [19]

Anderson

[11] 4,115,973

[45] Sep. 26, 1978

[54] BUILDING STRUCTURE

[75] Inventor: Richard N. Anderson, Owensboro, Ky.

[73] Assignee: V. E. Anderson Mfg. Co., Owensboro, Ky.

[21] Appl. No.: 613,824

[22] Filed: Sep. 16, 1975

Related U.S. Application Data

[62] Division of Ser. No. 325,337, Jan. 22, 1973, Pat. No. 3,905,154, which is a division of Ser. No. 36,303, Jun. 22, 1970, Pat. No. 3,711,995.

[51] Int. Cl.[2] ..... E06B 3/54

[52] U.S. Cl. ..... 52/773; 49/181; 49/463; 428/542; 52/775

[58] Field of Search ..... 49/181, 463, 464, 465, 49/466; 52/502; 160/90, 89, 91, 92; 428/542

[56] References Cited

U.S. PATENT DOCUMENTS

| | | | |
|---|---|---|---|
| 3,177,924 | 4/1965 | McPhail | 160/91 |
| 3,218,769 | 11/1965 | Brown et al. | 52/502 X |
| 3,445,964 | 5/1969 | Foster | 49/446 X |
| 3,674,082 | 7/1972 | Letarte | 52/502 X |
| 3,676,956 | 7/1972 | Taylor et al. | 49/181 X |
| 3,696,857 | 10/1972 | LeTarte | 52/502 X |
| 3,727,664 | 4/1973 | Mennuto | 160/90 |

*Primary Examiner*—Philip C. Kannan
*Attorney, Agent, or Firm*—Whittemore, Hulbert & Belknap

[57] ABSTRACT

Universal window structure which may be used as a single hung window, as a hopper window and as a right or left hand glider window without alteration is disclosed. Mulling means for securing a plurality of the window structures together, retaining clips for securing a screen thereto, false muntin structure, hurricane clips and piggyback storm window structure therefor and window trim structure for use therewith are specifically disclosed along with unique glazing strips, an insert for supporting sash balance structure, sealing strips and corner inserts, sash pivot structure, lock structure, sash guide and tilt release structure and hopper lock means for retaining the window sash in a plurality of separate tilted hopper positions. The frame of the window structure is constructed to permit rapid, accurate assembly with a minimum of low tolerance parts and to this end includes frame jamb adaptor extrusions. In addition, the total frame design allows many design variations whereby the universal window structure may be applied to and fit different building needs without additional job working or processing.

6 Claims, 111 Drawing Figures

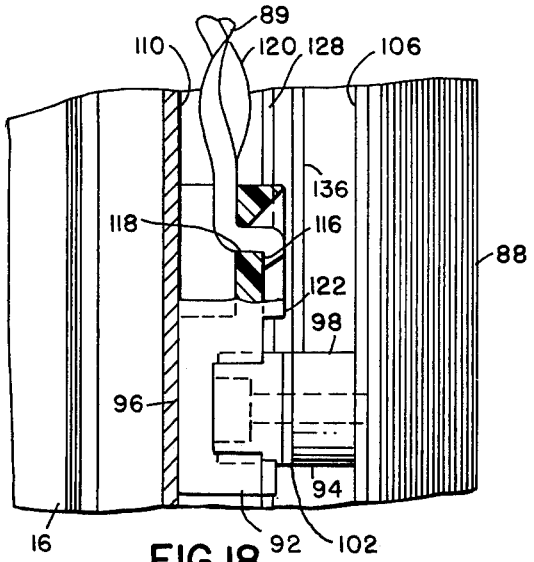
FIG.18
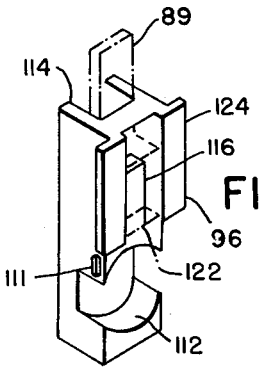
FIG.19
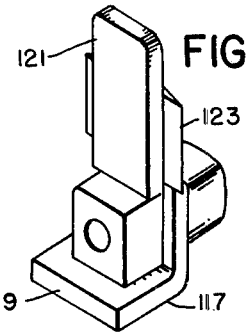
FIG.21
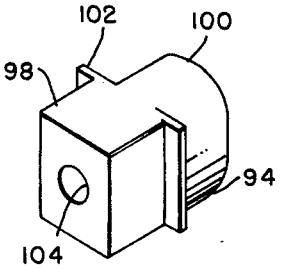
FIG.20
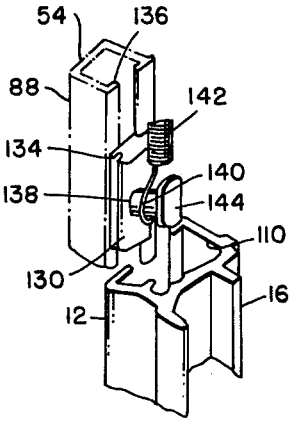
FIG.22
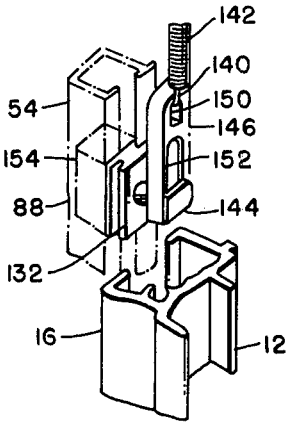
FIG.23
FIG.24
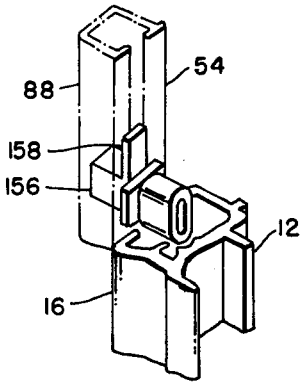

FIG.25
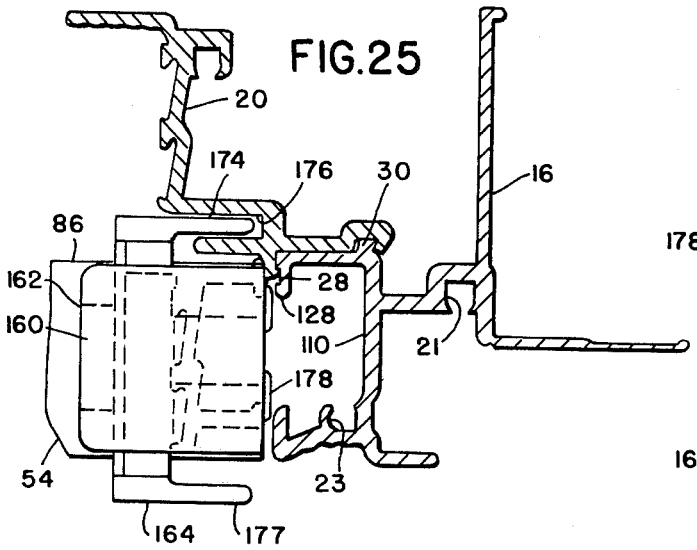
FIG.26
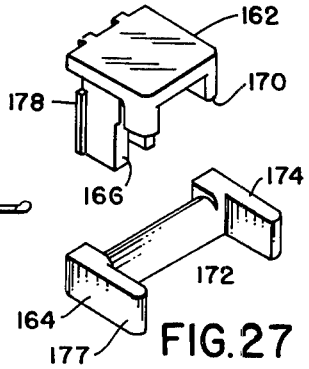
FIG.27
FIG.30
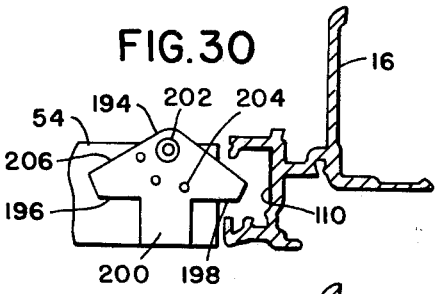
FIG.28
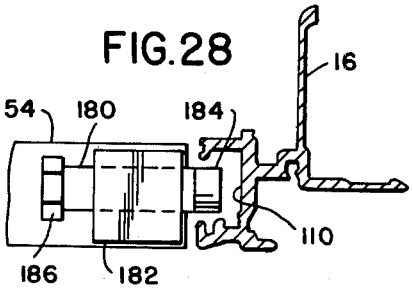
FIG.31
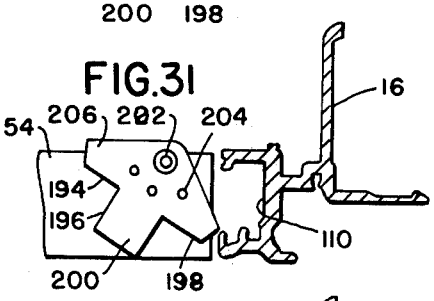
FIG.29
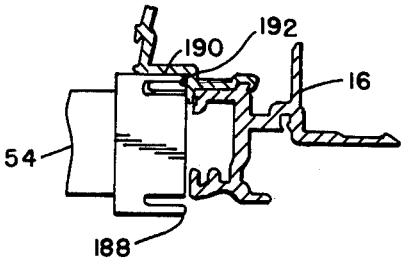
FIG.32
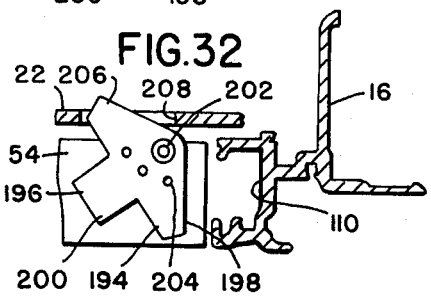

FIG.33
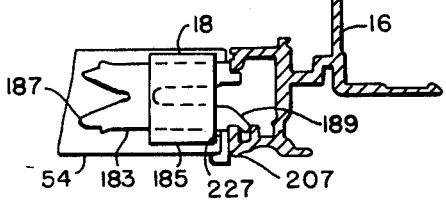
FIG.35
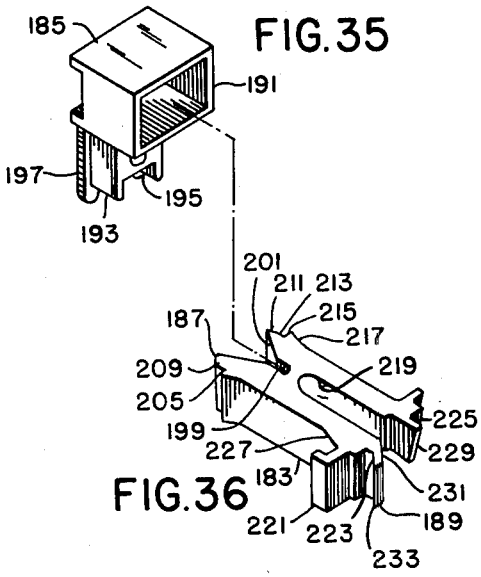
FIG.36
FIG.34
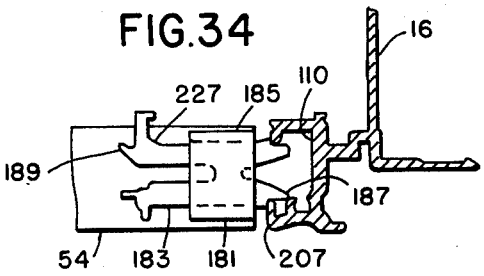
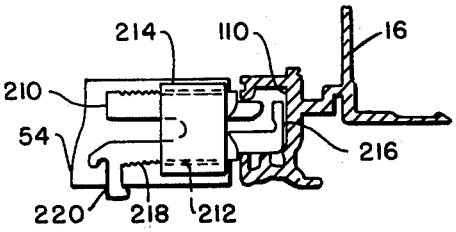
FIG.37
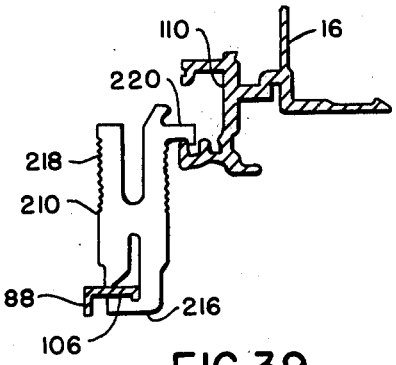
FIG.39
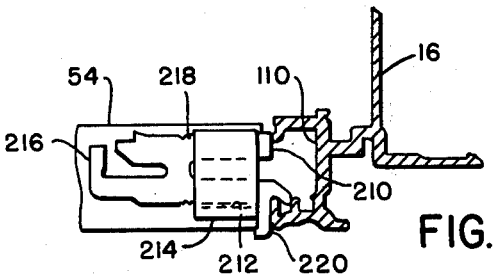
FIG.38

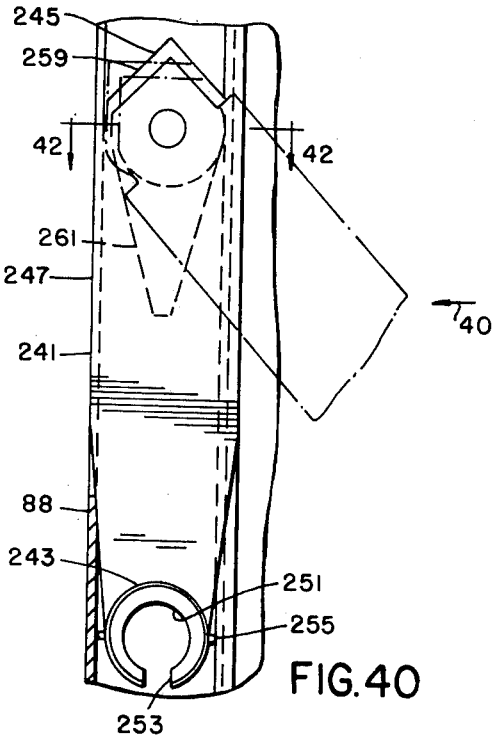
FIG.40
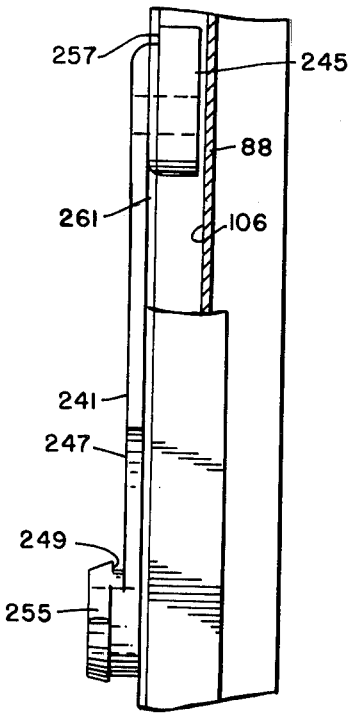
FIG.41
FIG.42
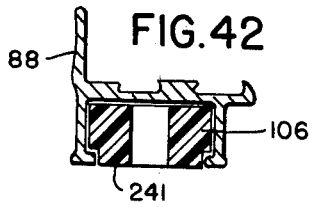
FIG.47
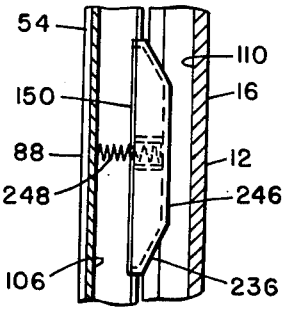
FIG.43
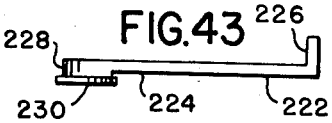
FIG.44
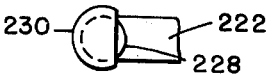
FIG.48
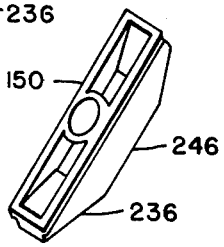
FIG.45
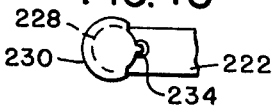
FIG.46
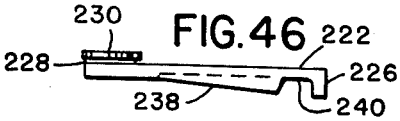

FIG.49
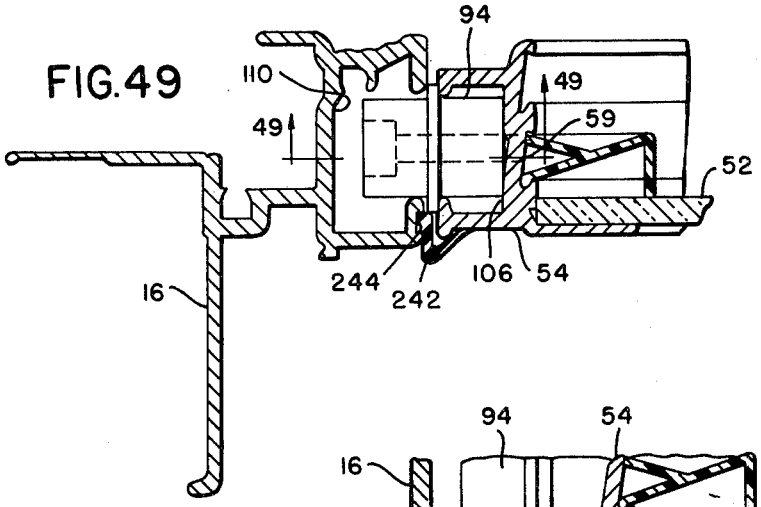
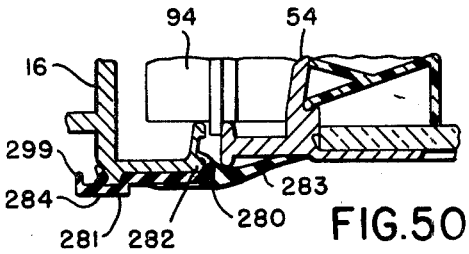
FIG.50
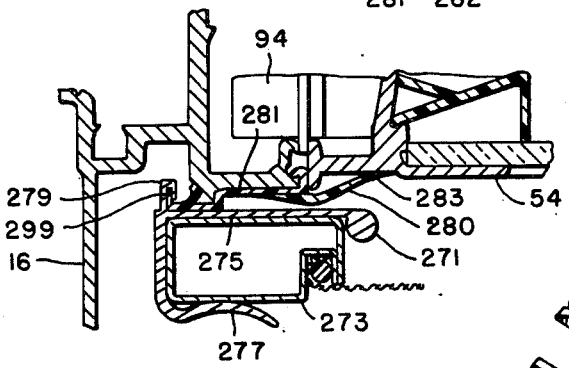
FIG.51
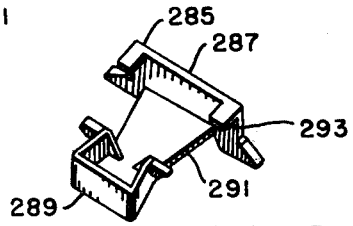
FIG.53
FIG.52
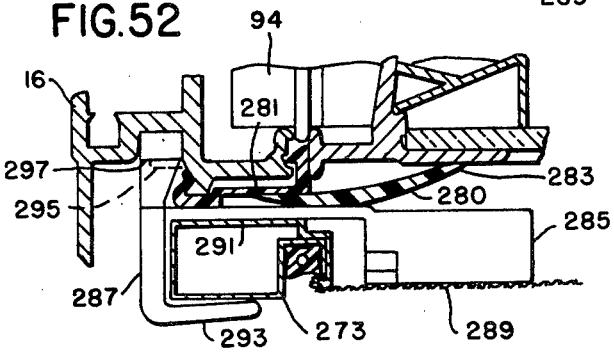

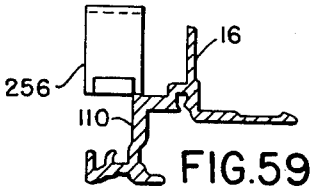
FIG.59
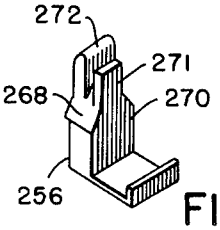
FIG.58
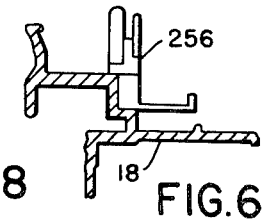
FIG.60
FIG.62
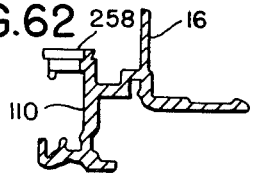
FIG.61
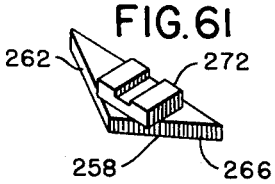
FIG.63
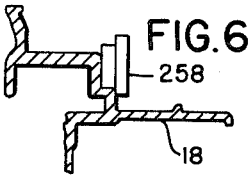
FIG.65
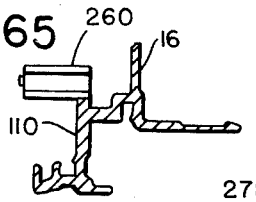
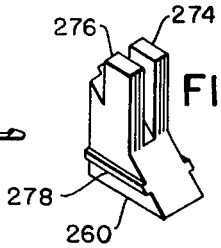
FIG.64
FIG.66
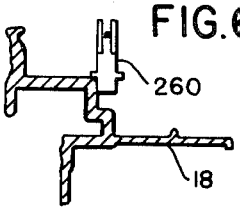
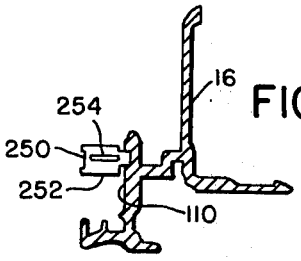
FIG.56
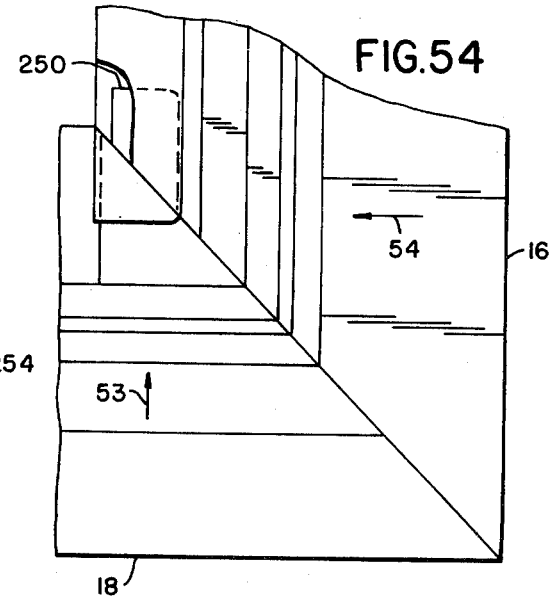
FIG.54
FIG.55
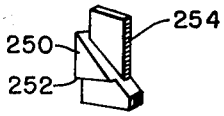
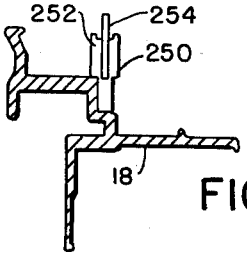
FIG.57

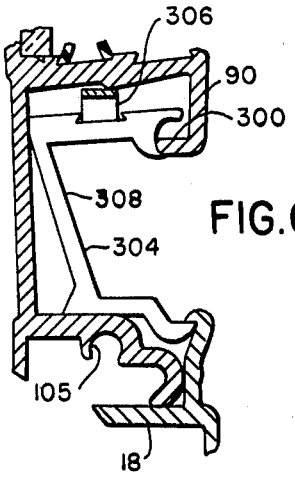
FIG.69
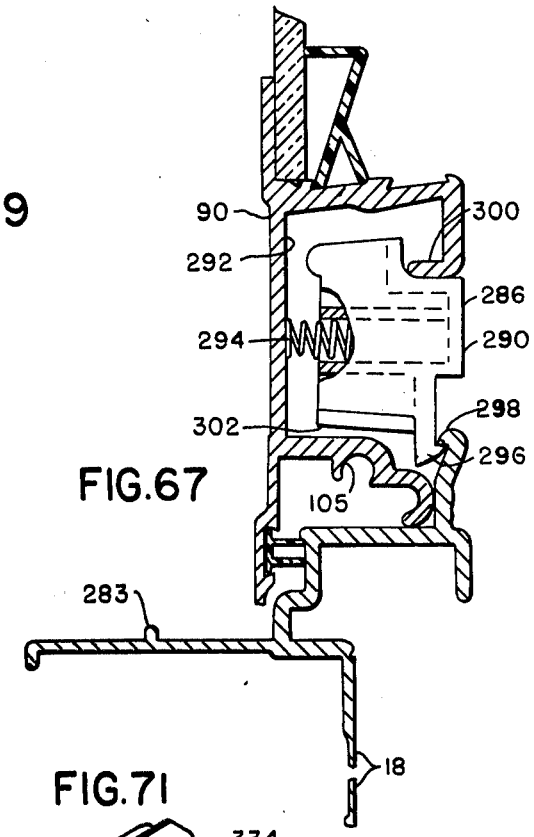
FIG.67
FIG.68
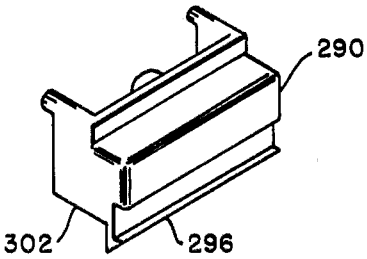
FIG.71
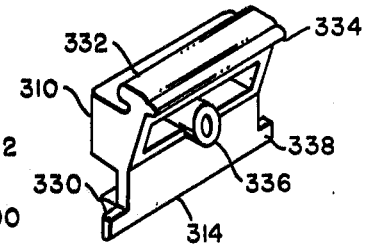
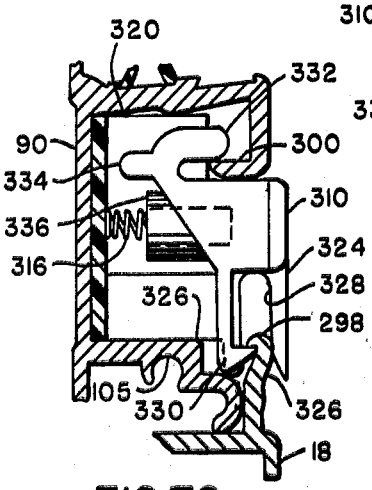
FIG.70
FIG.72
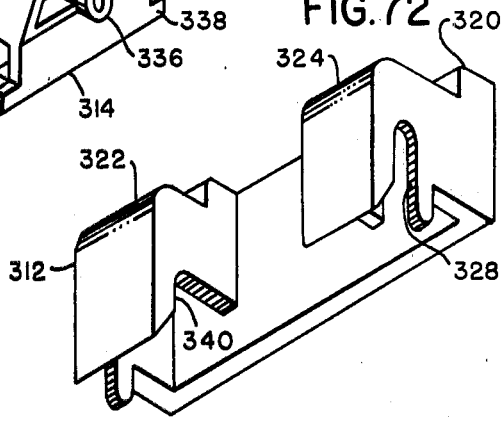

FIG.74
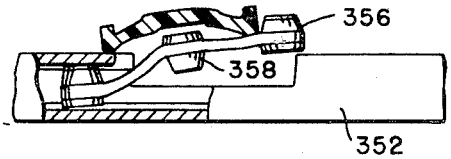
FIG.75
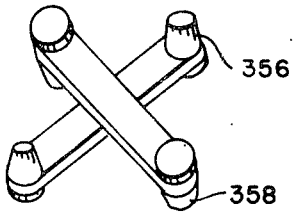
FIG.73
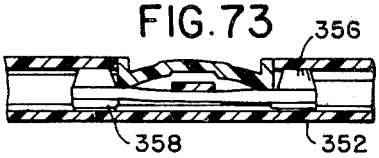
FIG.76
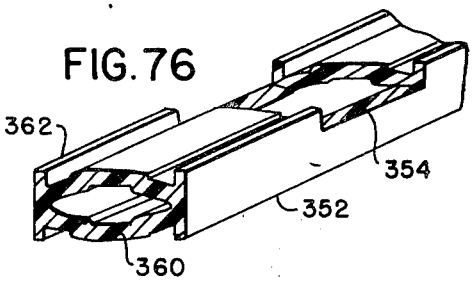
FIG.78
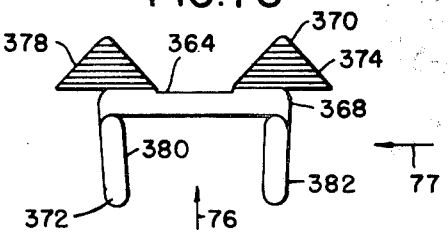
FIG.77
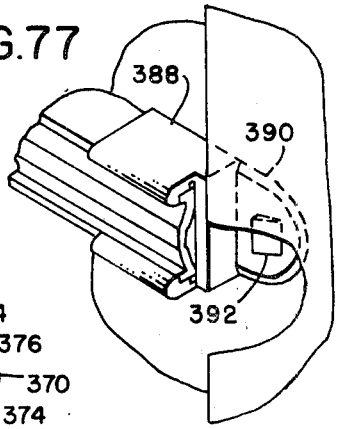
FIG.79
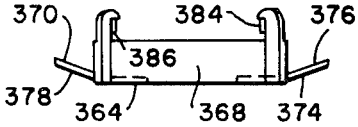
FIG.80
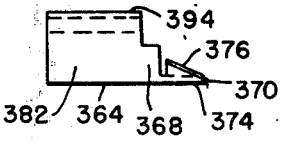
FIG.83
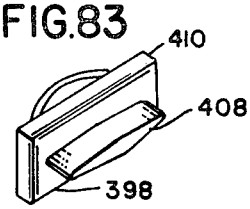
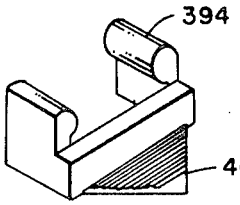
FIG.81
FIG.82
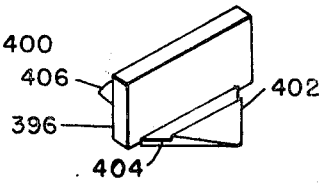

FIG.85
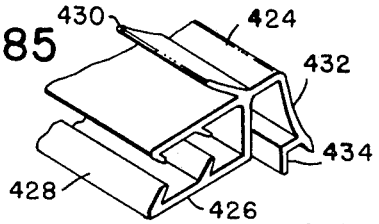
FIG.89
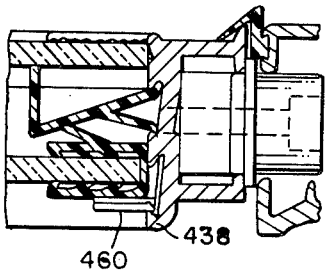
FIG.84
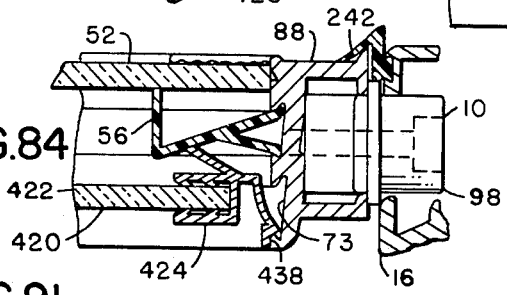
FIG.93
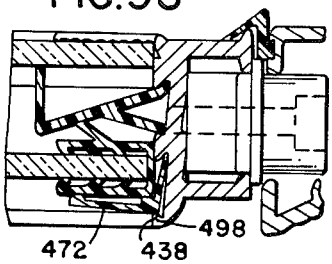
FIG.91
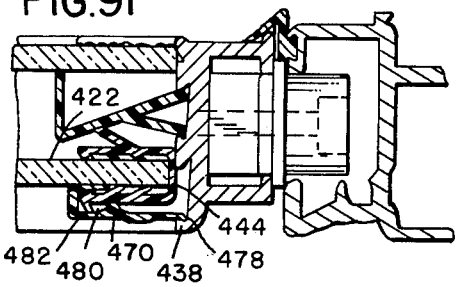
FIG.86
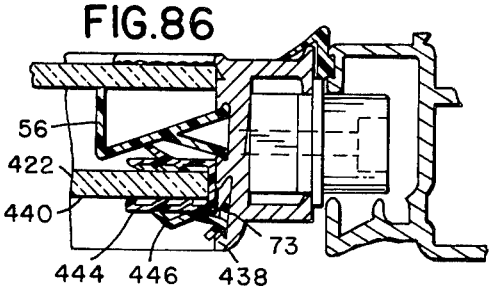
FIG.87
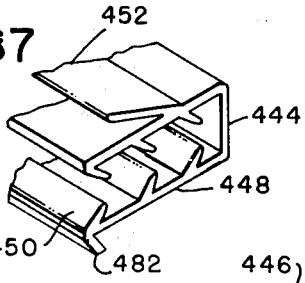
FIG.92
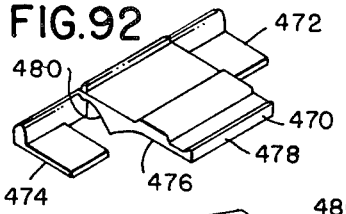
FIG.90
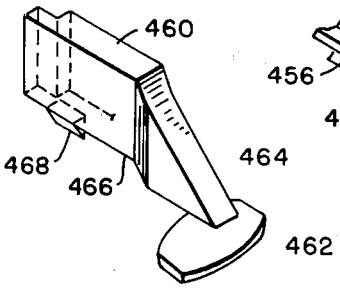
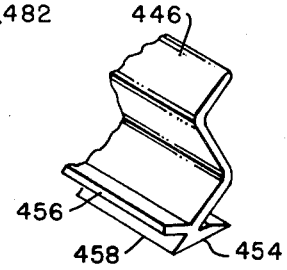
FIG.88
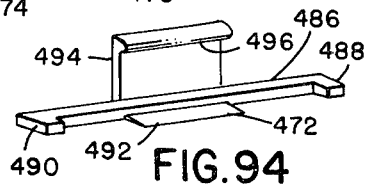
FIG.94

FIG.95
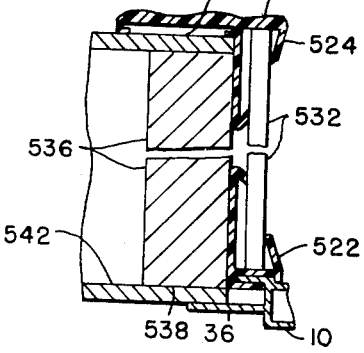
FIG.96
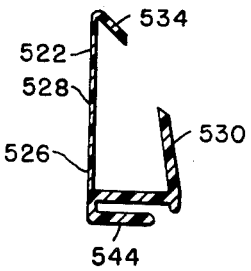
FIG.97
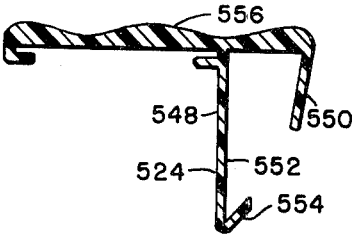
FIG.99
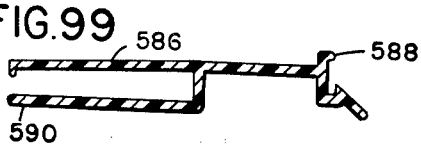
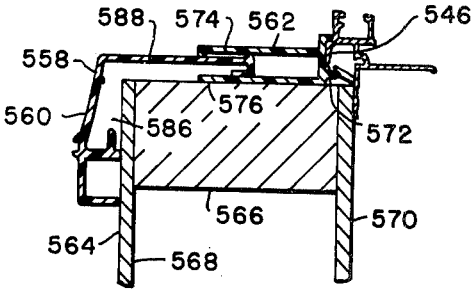
FIG.98
FIG.100
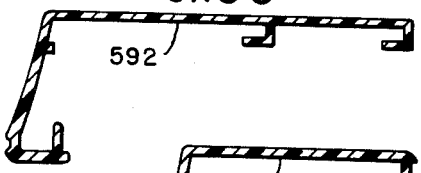
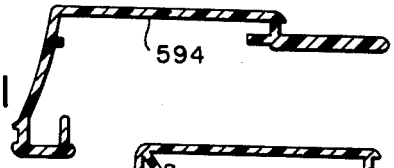
FIG.101
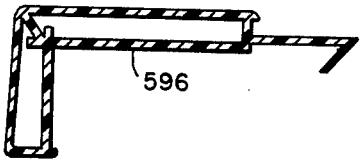
FIG.102
FIG.103
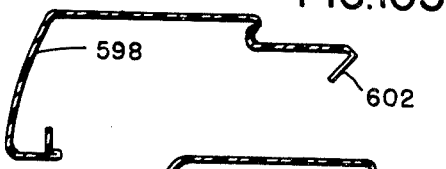
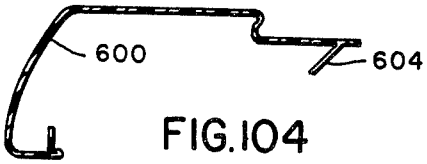
FIG.104
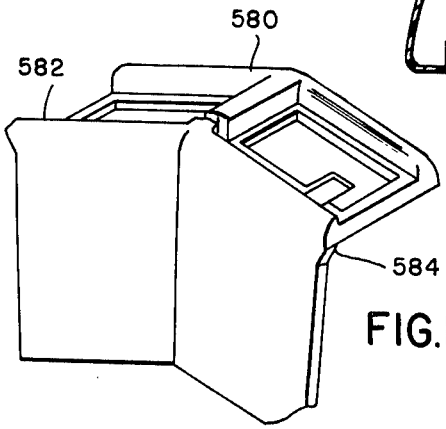
FIG.105

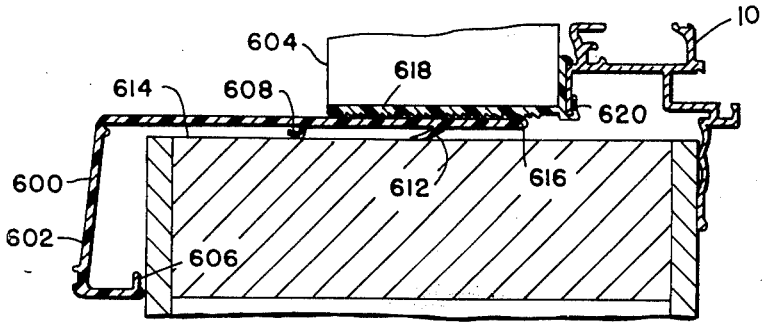
FIG.106
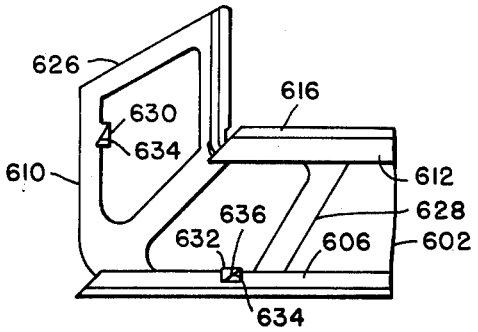
FIG.107
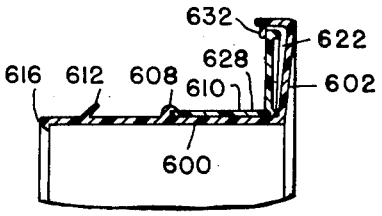
FIG.108
FIG.109
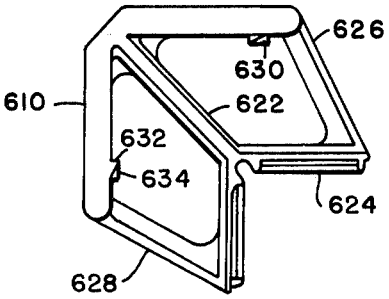
FIG.110
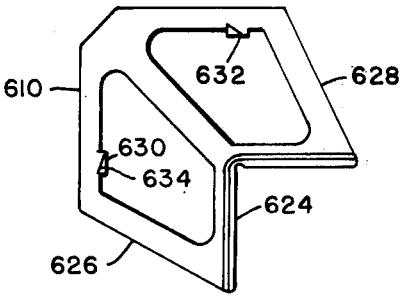
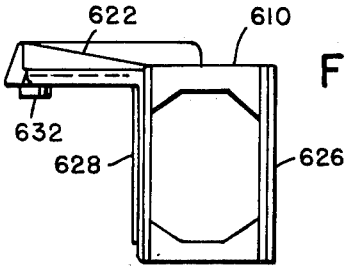
FIG.111

BUILDING STRUCTURE

CROSS-REFERENCE TO RELATED APPLICATIONS

The present application is a division of application Ser. No. 325,337, filed Jan. 22, 1973, now U.S. Pat. No. 3,905,154, which was a division of application Ser. No. 36,303, filed June 22, 1970, now U.S. Pat. No. 3,711,995. In addition, the present application is related to application Attorney No. 50,100, Ser. No. 7,452, filed Feb. 2, 1970, now U.S. Pat. No. 3,686,814, and Attorney No. 50,473, Ser. No. 38,453, filed May 18, 1970, now U.S. Pat. No. 3,824,753, which disclose the false muntin structure and storm sash structure for use with the window structure disclosed herein in more detail.

BACKGROUND OF THE INVENTION

1. Field of the Invention

The invention relates to building structure and refers more specifically to a prime window which is suitable for universal use as, for example, a single hung window, a hopper window or a right or left hand glider window without modification of the basic structure. The invention includes improvements in window frame construction, mulling means for the window, screen retaining clips, glazing strips, sash balance supporting structure, sealing structure including sealing strips, corner inserts and hurricane clips, pivot structure and locking means for the window and improvements in structure for guiding and releasing the movable sash of the window and for retaining the movable sash in use as a hopper window in predetermined pivoted positions along with false muntin structure, piggyback storm sash and window trim structure for the window.

2. Description of the Prior Art

In the past, window structure has generally been designed for a single use. That is, it has been designed as a single hung window, as a hopper window, or as a glider window, for example. Such single purpose windows require large dealer inventories to meet demand for each type of window, which is undesirable.

In addition, window structures of the past have not been constructed to be as simply manufactured with tolerances as low as the window structure of the invention so that they have had relatively high production costs. Also, with past window structures it has not always been possible to as readily mull the window structures for multiple installation or to retain accessories such as screens and sash balances in assembly therewith.

Furthermore, the sealing of prior window structures has permitted excessive air passage, and the pivot details of hopper windows have not permitted raising and lowering of the hopper sash. Thus, windows permitting up and down movement of a sash have rarely in the past also permitted swinging of the sash about one edge thereof.

Also, the locking means of prior window structures has not generally permitted movement of the locking means on the sash, and no provision for ventilation with a locked window has been provided in slidable windows of the past without the addition of secondary hardware. Further, separate means for locking, guiding and securing the hopper sash in a pivoted positon have often been required in previous window structures which have added to the expense of the window structures.

Wherein separate small glazing panels have been provided in windows of the past, either separate dividing muntins have been required or false muntin structure has been used which has been complicated and therefore expensive. Similarly, storm windows of the past have usually been complete window structures in themselves positioned over the entire prime window structure whereby many of the components of the prime window structure have been unnecessarily duplicated. Window trim specifically constructed to make a rapid, economical and esthetically pleasing transition between a window and adjacent wall has not generally been available previously.

SUMMARY OF THE INVENTION

The window constructed in accordance with the invention functions without modification as a single hung window, a hopper window and a glider window due to the elimination of fixed tongue and groove guide means between the window frame and movable sash permitting ready separation of the sash and frame. The window frame has been constructed to require a minimum of close tolerance parts and to facilitate assembly thereof as well as to accommodate assembly therewith of a screen and sash balance if required.

The glazing of the window has been improved with special glazing strips, pivoting of the movable sash and removal thereof has been improved by means of special pivot structure. Locking of the movable sash of the window structure has also been improved by the inclusion of particular locking construction in the window and the guiding of the movable sash of the window is accomplished by unique construction in accordance with the invention.

Sealing of the movable sash is accomplished by improved sealing strips, hurricane clips and frame corner inserts, while the retaining of the movable sash in a hopper position is improved with hopper locks provided in accordance with the invention.

Also, a simple, economical and efficient false muntin structure and a storm window sash adapted to be secured to prime window structure in a piggyback fashion are included in the universal window structure invention along with unique trim moldings for facilitating the esthetic installation of the window.

BRIEF DESCRIPTION OF THE DRAWINGS

FIG. 18 is an enlarged broken away partial section view of the jamb of the window structure illustrated in FIG. 1 particularly showing the sash pivot structure and a removable sash balance in assembly therewith.

FIG. 19 is a perspective view of a part of the pivot structure of the window structure illustrated in FIG. 18.

FIG. 20 is a perspective view of another part of the pivot structure of the window structure illustrated in FIG. 18.

FIG. 21 is a perspective view of a modification of the part of the pivot structure illustrated in FIG. 20.

FIGS. 22, 23 and 24 are perspective views of sash pivot structure modifications suitable for use in the window structure of FIG. 1.

FIG. 25 is a section view of the jamb extrusion of the window frame and jamb adaptor extrusion of the window structure illustrated in FIG. 1 showing a plan view of the head of the movable sash and sash guide and tilt release structure in assembly therewith.

FIG. 26 is a perspective view of a portion of the sash guide and tilt release structure illustrated in FIG. 25.

FIG. 27 is a perspective view of another portion of the sash guide and tilt release structure illustrated in FIG. 25.

FIGS. 28 and 29 are plan views of sash guide and tilt release structure modifications suitable for use with the window structure of FIG. 1.

FIGS. 30, 31 and 32 are plan views of a combination sash guide, tilt release and locking structure modification suitable for use with the window structure of FIG. 1.

FIGS. 33 and 34 are plan views of another sash guide and tilt release structure modification suitable for use in the window structure of FIG. 1.

FIGS. 35 and 36 are perspective views of the parts of the sash guide and tilt release structure illustrated in FIGS. 33 and 34.

FIGS. 37, 38 and 39 are plan views of still another sash guide and tilt release structure modification suitable for use in the window structure of FIG. 1 which also includes a hopper lock feature.

FIG. 40 is an enlarged partial section view of the sash jamb extrusion of the window structure illustrated in FIG. 1 showing a hopper lock or sash retaining link in a pivoted position therein.

FIG. 41 is an elevation view of the hopper lock illustrated in FIG. 40 taken in the direction of arrow 41 in FIG. 40 and showing a portion of the sash jamb in assembly therewith.

FIG. 42 is a section view of the hopper lock illustrated in FIG. 40 taken substantially on line 42—42 in FIG. 40 and showing a portion of the sash jamb in assembly therewith.

FIG. 43 is an elevation view of a modified hopper lock suitable for use with the window structure of FIG. 1.

FIGS. 44, 45 and 46 illustrate modifications of the hopper lock modification illustrated in FIG. 43.

FIG. 47 is a section view of the jamb of the window structure illustrated in FIG. 1 taken substantially on the line 47—47 in FIG. 49 and showing a hurricane clip constructed in accordance with the invention in assembly therewith.

FIG. 48 is a perspective view of the hurricane clip illustrated in FIG. 47.

FIG. 49 is an enlarged section view of the jamb of the window structure illustrated in FIG. 1 particularly showing the sealing strip between the window frame and movable sash.

FIG. 50 is a partial section view similar to that of FIG. 49 and illustrating a modified sealing strip positioned between the window frame and movable sash.

FIG. 51 is a partial section view of the window structure of FIG. 1 similar to that of FIG. 50 and illustrating a screen retainer clip constructed in accordance with the invention in assembly therewith.

FIG. 52 is a partial section view of the window structure of FIG. 1 similar to that of FIGS. 50 and 51 and illustrating a modified screen retainer clip constructed in accordance with the invention in assembly therewith.

FIG. 53 is a reduced perspective view of the modified screen retainer clip illustrated in FIG. 52.

FIG. 54 is an elevation view of the lower right hand corner of the window structure illustrated in FIG. 1 showing a corner insert constructed in accordance with the invention in assembly therewith.

FIG. 55 is a reduced perspective view of the corner insert illustrated in FIG. 54.

FIG. 56 is a reduced cross section view of the jamb extrusion of the window frame showing the corner insert of FIG. 55 in assembly therewith taken in the direction of arrow 56 in FIG. 54.

FIG. 57 is a reduced cross section view of the sill extrusion of the window frame showing the corner insert of FIG. 55 in assembly therewith taken in the direction of arrow 57 in FIG. 54.

FIGS. 58, 59 and 60 and FIGS. 61, 62 and 63 and FIGS. 64, 65 and 66 are similar to FIGS. 55, 56 and 57 and illustrate modified corner inserts in perspective view and in assembly with the jamb extrusion and the sill extrusion of the window frame respectively.

FIG. 67 is an enlarged section view of the sill of the window structure illustrated in FIG. 1 showing the locking mechanism therefor.

FIG. 68 is a reduced perspective view of a portion of the locking mechanism illustrated in FIG. 67.

FIG. 69 is a section view similar to that of FIG. 67 and illustrating modified locking structure for use with the window structure of FIG. 1.

FIG. 70 is a section view similar to FIG. 69 showing another modified window locking structure in assembly therewith.

FIGS. 71 and 72 are perspective views of parts of the locking structure illustrated in FIG. 70.

FIG. 73 is an enlarged partial section view of false muntin structure for use with the window structure illustrated in FIG. 1 taken on the line 73—73 in FIG. 2.

FIG. 74 is a section view of the false muntin structure similar to FIG. 73 and showing the method of connection of the false muntin bar members.

FIG. 75 is a perspective view of the interlocking member of the false muntin structure illustrated in FIG. 73.

FIG. 76 is a perspective view of one of the false muntin members of the false muntin structure illustrated in FIG. 73.

FIG. 77 is an enlarged perspective view of a universal retaining clip for securing the false muntin structure illustrated in FIGS. 2 and 3 to the frame of the universal window structure.

FIG. 78 is an enlarged plan view of a modified universal retaining clip for use in securing the false muntin structure to the frame of the universal window.

FIG. 79 is an elevation view of the retaining clip illustrated in FIG. 78 taken substantially in the direction of arrow 79 in FIG. 78.

FIG. 80 is an elevation view of the retaining clip illustrated in FIG. 78 taken in the direction of arrow 80 in FIG. 78.

FIGS. 81, 82 and 83 are perspective views of additional modifications of the retaining clip illustrated in FIG. 77.

FIG. 84 is a section view of one jamb of the window structure illustrated in FIG. 1 showing storm sash structure constructed in accordance with the invention in assembly therewith.

FIG. 85 is an enlarged perspective view of a dual durometer plastic strip member of the storm sash structure illustrated in FIG. 84.

FIG. 86 is a section view similar to the section view of FIG. 84 and showing modified storm sash structure in assembly with the window structure of FIG. 1.

FIG. 87 is an enlarged perspective view of a dual durometer plastic strip member of the storm sash structure illustrated in FIG. 86.

FIG. 88 is a perspective view of a retainer clip for use in securing a storm sash as illustrated in FIG. 86 to the window structure illustrated in FIG. 1.

FIG. 89 is another section view similar to the section view of FIG. 84 and showing another modified storm sash structure in assembly with the window structure of FIG. 1.

FIG. 90 is a perspective view of a retainer clip for use in securing a storm sash as illustrated in FIG. 86 to the prime window structure illustrated in FIG. 1.

FIG. 91 is another section view similar to the section view of FIG. 84 and showing still another modified storm sash structure in assembly with the window structure of FIG. 1.

FIG. 92 is a perspective view of a retainer clip for use in securing a storm sash as illustrated in FIG. 91 to the prime window structure illustrated in FIG. 1.

FIG. 93 is another section view similar to the section view of FIG. 84 and showing still another modified storm sash structure in assembly with the window structure of FIG. 1.

FIG. 94 is a perspective view of a retainer clip for use in securing a storm sash as illustrated in FIG. 93 to the window structure illustrated in FIG. 1.

FIG. 95 is a section view of one jamb of the window structure illustrated in FIG. 1 secured in position in a wall and particularly illustrating window trim structure constructed in accordance with the invention in assembly therewith.

FIGS. 96 and 97 are enlarged cross section views of trim members of the window trim structure illustrated in FIG. 95.

FIG. 98 is a section view of one jamb of the window structure illustrated in FIG. 1 secured in position in a wall and illustrating modified window trim structure constructed in accordance with the invention in assembly therewith.

FIG. 99 is a cross section view of an expander member for use in window trim structure as illustrated in FIG. 98.

FIGS. 100, 101, 102, 103 and 104 are section views of modified window trim members for use in window trim structure as illustrated in FIG. 98.

FIG. 105 is a perspective view of an enlarged corner bracket for use in window trim structure as illustrated in FIG. 98.

FIG. 106 is a section view, similar to FIG. 98, of one jamb of the window structure illustrated in FIG. 1 secured in position in a wall and illustrating modified window trim structure constructed in accordance with the invention in assembly therewith.

FIGS. 107 and 108 are views of the mitered end of one of the window trim members illustrated in FIG. 106 and illustrating a corner bracket in assembly therewith.

FIGS. 109, 110 and 111 are top, bottom and side views respectively of the corner bracket illustrated in FIGS. 107 and 108 for securing the window trim structure in FIG. 106 together at mitered corners.

DESCRIPTION OF THE PREFERRED EMBODIMENTS

Figure 1:
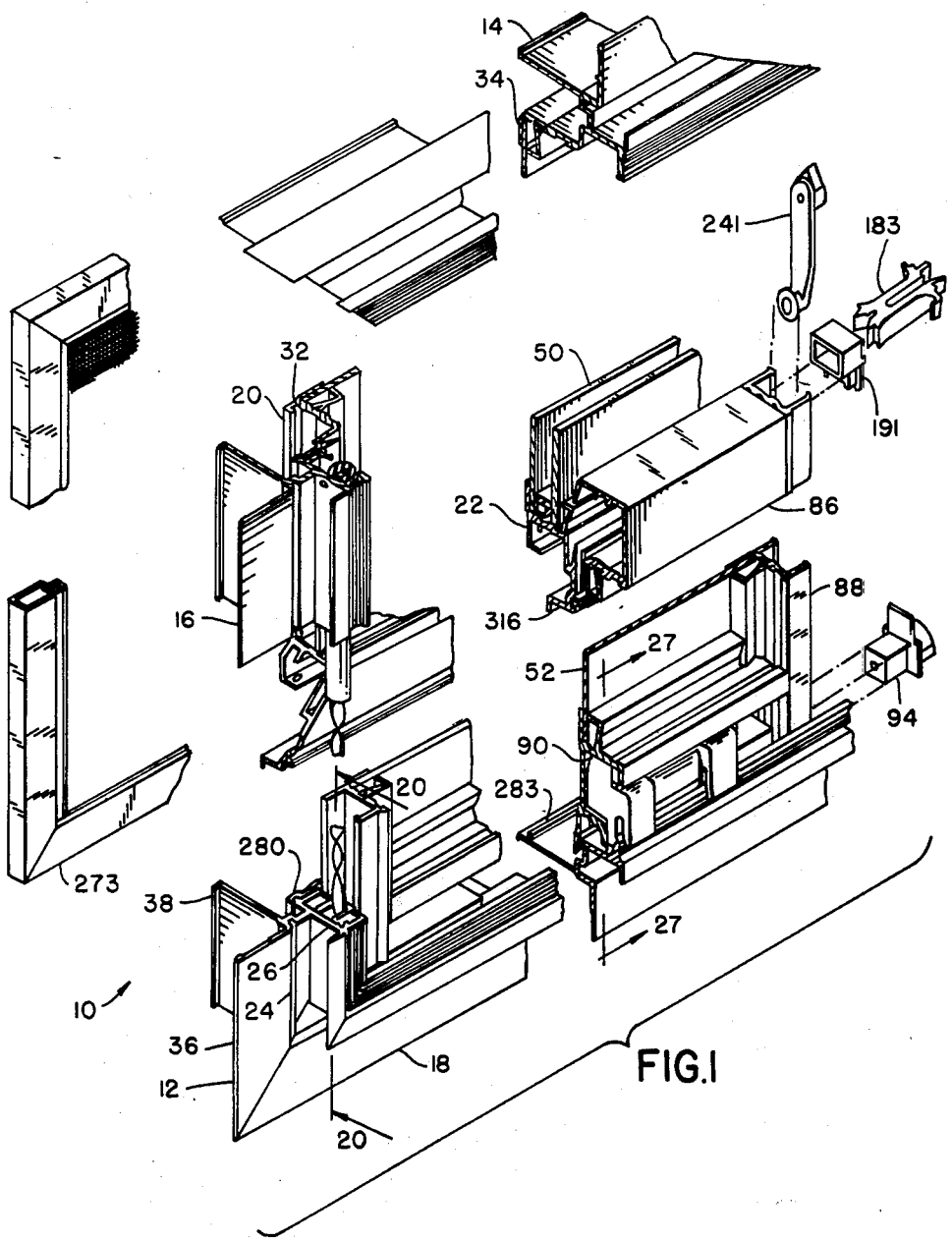
FIG. 1 is an exploded broken view of the universal window structure of the invention.
Figure 2:
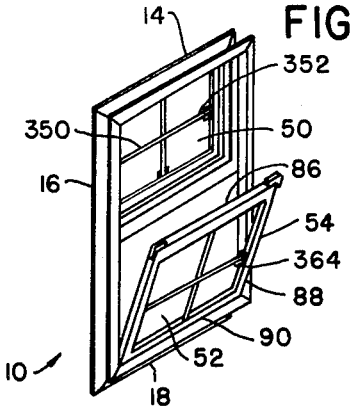
FIG. 2 is a reduced perspective view of the window structure illustrated in FIG. 1 in the position of the window structure installed as either a single hung or hopper window with the movable sash in a tilted or hopper position and illustrating false muntin structure in assembly therewith.
Figure 3:
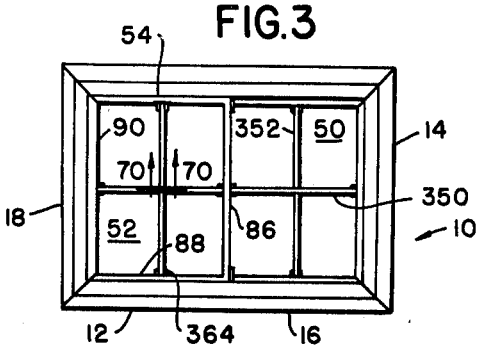
FIG. 3 is a reduced view of the window structure of FIG. 1 in the position of the window structure installed as a glider window with the movable sash closed and false muntin structure in assembly therewith.

The universal, prime window structure of the invention illustrated in use as a hopper window and as a glider window in FIGS. 2 and 3 respectively is shown in more detail in FIG. 1.

Figure 8:
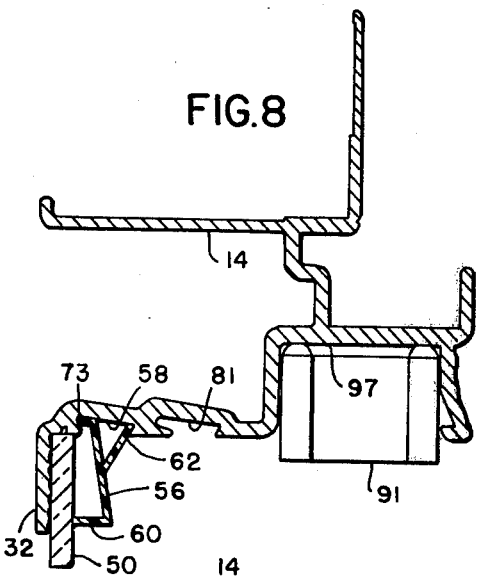
FIG. 8 is an enlarged section view of the head extrusion of the window structure illustrated in FIG. 1 particularly showing a glazing strip and a sash balance mounting insert in accordance with the invention in assembly therewith.

The window structure of FIG. 1 includes a frame 12 constructed of head, jamb and sill extrusions 14, 16 and 18, best shown in FIGS. 8, 24 and 64 respectively, in conjunction with a jamb adaptor extrusion 20 shown in FIG. 24 and a frame check rail extrusion 22 extending between the jamb extrusions 16 centrally thereof. The head, jamb and sill extrusions are mitered at the corners of the frame 12 and are secured together by means of screws extending through the head and sill extrusions at the ends thereof and into the screw runner grooves 21 and 23 in jamb members 16.

Jamb adaptor extrusions 20 are formed from an extrusion section miter-cut at each end and then cut in two centrally. The jamb adaptor extrusions 20 having one square-cut end are then slidably mounted on the frame jamb extrusions 16 by means of the cooperating tongue and groove structures 28 and 30 illustrated best in FIG.

24. The square-cut ends of the jamb adaptor extrusions 20 are positioned against the head extrusion 14 with the glazing flange 32 of the head extrusion 14 notched to receive the square-cut ends of the jamb adaptor extrusions 20.

The mitered ends of the frame check rail 22 are then placed in engagement with the miter-cut ends of the jamb adaptor extrusions 20 and the frame check rail is screw-connected to the jamb extrusions 16 to complete the frame 12. If desired, additional screws may be inserted through the frame check rail 22 and into the screw runner grooves 32 of the jamb adaptor extrusions 20 and through the head extrusion 14 of the window frame 12 and into the screw runner grooves 32. The additional screws provide a more rigid construction; however, are not essential.

The particular jamb adaptor extrusions 20 and their assembly with the frame 12 in the construction of the window structure 10 simplifies the extrusions necessary for the frame 12 and the tolerances which must be maintained in cutting the frame members. Thus, the jambs 16 may be of a single extrusion in cross section for their entire length. Furthermore, since the check rail extrusion 22 is not particularly critical in location vertically of the window frame 12, the jamb adaptor extrusion sections from which extrusions 20 are formed need not be initially cut to an exact length but need only be divided centrally, since in assembly they will then similarly position the ends of the check rail extrusion 22 vertically of the frame 12. Also, with the slip fit of the jamb adaptor extrusions 20, fabrication of the jamb adaptor extrusions and frame jamb, head and check rail extrusions is minimized.

Figure 4:
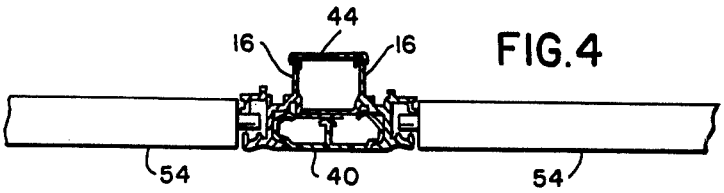
FIG. 4 is a broken section view of a pair of window structures such as illustrated in FIG. 1 mounted adjacent each other with mulling structure therebetween in accordance with the invention.
Figure 5:
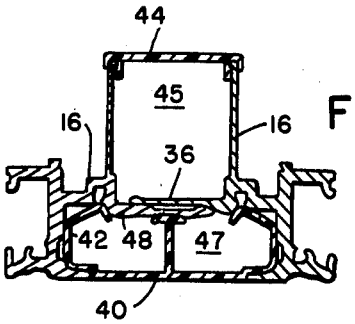
FIG. 5 is an enlarged section view of the mulling structure and associated window structure illustrated in FIG. 4.

With the frame 12 including the nailing flange 36 and extension 38 therearound, window structures such as that illustrated in FIG. 1 in either the position illustrated in FIG. 2 or FIG. 3 may be mulled side by side or vertically with the mull structure illustrated in FIGS. 4 and 5. Thus, multiple adjacent window installation is possible with the window structure 10.

As shown best in FIG. 5, adjacent window structures 10 are positioned so that the nailing flanges 36 overlap when it is desired to mull the window structures. In assembly the inside mulling member 40 is then first clipped into the pocket 42 formed in the jamb extrusion 16 of a window structure 10 installed in a fixed location. The second window structure 10 is then placed adjacent the first window structure with the nailing flanges 36 overlapping as shown in FIG. 5, and the inside mull member 40 is clipped into the pocket 42 in the jamb extrusion 16 of the second window structure 10. The outside mull member 44 is then clipped over the extensions 38 of the window structures as shown in FIG. 5 to complete the mulling of the window structures.

The mulling of window structure 10 as shown in FIGS. 4 and 5 utilizes a double rain screen principle. Thus, the area 45 between the exterior mull member 44 and the nailing flanges 36 is exposed to a greater exterior pressure than the area 47 between the nailing flanges 36 and the interior mull member 40 and the seal provided by the mull member 44, nailing flanges 36 and mull member 40 is progressively tighter toward the mull member 40. Rain driven into area 45 is thus less likely to penetrate through area 47 and ultimately into the interior of a building having window structure 10 installed therein than with other mull structure.

Figure 6:
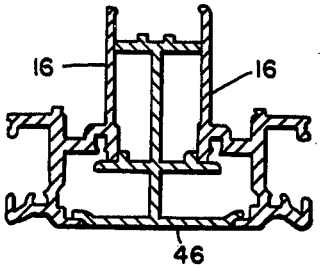
FIG. 6 is an enlarged section view similar to FIG. 5 illustrating modified mulling structure for mulling the window structure of FIG. 1.
Figure 7:
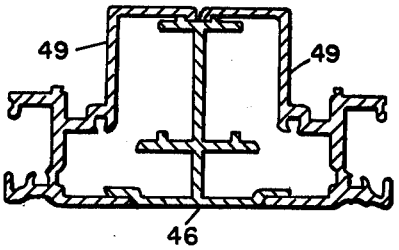
FIG. 7 is an enlarged section view of mulling structure such as illustrated in FIG. 6 for mulling window structure having a modified window frame cross section.

The window structure 10 may also be mulled with the mulling extrusion 46 illustrated in FIG. 6. When using the mulling extrusion 46, the nailing flanges 36 of jamb extrusions 16 are broken off at the notch 48 shown in FIG. 5. Again, the mulling extrusion 46 is positioned in assembly with a first window structure 10 as illustrated in FIG. 6, and a second window structure 10 is then assembled with the mulling extrusion 46 to complete the mulling operation. The mulling extrusion 46 may also be used to mull window structures having different jamb extrusion cross sections 49 as particularly illustrated in FIG. 7.

The glazing panels 50 and 52 of the window structure 10 as particularly shown in FIG. 8 are secured in the frame 12 and the window sash 54 by glazing strips 56 which are received recesses recess in the frame and sash members such as recess 58 in the frame head extrusion 14. The glazing strip 56 illustrated in FIG. 8 was evolved from the glazing strips illustrated in FIGS. 9 and 10 and includes a generally L-shaped member which is adapted to be secured in the recess 58 with one end 60 in engagement with the periphery of a glazing panel to hold the glazing panel in position.

Separating the end 62 of the glazing strip 56 into two leg portions permits easy assembly of the strip 56 in recesses 58 and 61, while inclining the portion of the strip 56 between the ends 60 and 62 thereof at an angle to the glazing panel 50 with the portion thereof adjacent the end 60 independently flexible permits use of a single glazing strip with a greater selection of glazing panel widths with substantially the same esthetics. Thus, with only the two separate glazing strips 56 and 76 of FIGS. 8 and 11, substantially the entire range of normal glass widths may be glazed in either the frame 12 or the sash 54 of the window structure 10.

Figure 9:
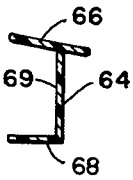
FIGS. 9, 10, 11, 12 and 13 illustrate possible modifications of the glazing strip cross section illustrated in FIG. 8.

More specifically, the modified glazing strip 64 of FIG. 9 includes the initial L-shaped portion 68 having a solid foot portion 66 connected to one end thereof. The part 69 of the L-shaped portion of strip 64 is nominally parallel to a glass pane glazed thereby.

Figure 10:
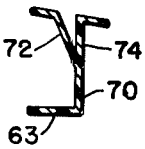

The modified glazing strip 70 illustrated in FIG. 10 shows the foot portion and part of the one end of the L-shaped portion of the glazing strip split to provide leg parts 72 and 74 permitting easier assembly and disassembly of the strip 70 by the flexing of the leg parts 72 and 74.

The glazing strip 56 of FIG. 8 followed strips 64 and 70 to provide for uniform glazing strip appearance with different thicknesses of glass and to provide greater clamping strength for the glazing strip 56 on the glazing panel 50.

Figure 11:
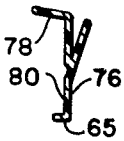

Glazing strip 76 illustrated in FIG. 11 was developed along with and is substantially the same as glazing strip 56. Glazing strip 76 has a longer foot portion 78. Also, the part 80 of the L-shaped portion of the glazing strip 76 is less inclined than the similar portion of the glazing strip 56, and the part 65 of the L-shaped portion of the glazing strip 76 is considerably shorter than the corresponding part 60 of the glazing strip 56. The glazing strip 76 is used in the first recess 58 to accommodate glazing panels thicker than can be conveniently glazed with glazing strip 56 in the first recess 58 and thinner than can be conveniently glazed with glazing strip 56 in recess 81. The glazing strip 76 is used in conjunction with the second recess 81 in the frame and sash members to permit installation of particularly thick insulating glazing panels in the window structure 10. By using the two glazing strips 56 and 76 in conjunction with the two recesses 58 and 81 in the window structure 10, the entire range of normal glazing panel thicknesses may be accommodated in the window structure 10 so that only two glazing strips need be stocked.

Figure 12:
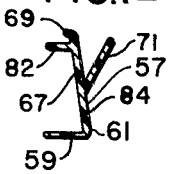

A projection 82 has been provided on the modified glazing strip 84 which is otherwise substantially the same as the glazing strip 56. The projection 82 as shown in FIG. 12 is used to flex the part 67 of the glazing strip 84 to allow movement of the foot portion 69 into the recess 58 or 81. Thus, the glazing strip 84 may be hand installed by first placing the part 71 in a recess 58 or 81 and pivoting the glazing strip toward the glazing panel about the part 71 so that the foot portion 69 is rotated into the recess 58 or 81 due to flexing of the part 67 away from the glazing panel on contact of the projection 82 with the glazing panel. In contrast, the foot portion 73 of the glazing strip 56 is first inserted in a recess 58 or 81 and a tool is used to roll the leg portion 62 into the recess 58 or 81 on installation of the glazing strip 56.

The glazing strip 84, as shown in FIG. 12, has the cross section shown including a first straight portion 57, one end 61 of which is independently flexible. A second straight portion extends substantially perpendicularly from the other end of the first portion 57 to aid in securing the glazing strip to a window frame, in conjunction with a third portion 71 which is connected to the first portion 57 of the cross section of the glazing strip 84 and diverges from the second portion of the glazing strip. A third straight portion 59 depends substantially perpendicularly from the one end of the first portion 57 and is adapted to engage a window pane secured in the frame by the glazing strip 84 on flexing of the end 61 of the portion 57 of the glazing strip. A fourth straight portion 82 of the cross section of the glazing strip 84 shown in FIG. 12 is connected to the other end of the first portion 57 and extends in the same direction as the portions 59 and 69 of the cross section of the glazing strip for the purpose of flexing the end 67 of the first portion 57 of the glazing strip to permit inserting of the portion 69 of the glazing strip in a groove 58 or 18 provided therefor in the window frame.

Figure 13:
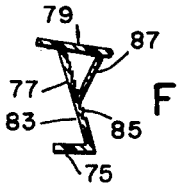

The modified glazing strip 77 illustrated in FIG. 13 includes the foot portion 79 adapted to be inserted in the recess 58 or 81 to secure the strip 77 to the frame or sash of the window structure 10, the L-shaped portion 83 connected to the foot portion 79 at one end and having the notches 85 therein as shown and the portion 87 connected to the foot portion 79 and separated from the L-shaped portion 83. In use, the portion 87 of the glazing strip 77 is urged into wedging engagement with the notches 85 to force the end 75 of the L-shaped portion 83 against a glazing panel. The glazing strip 77 has the advantage of being easy to install without the use of special equipment. The glazing strip 77 also accommodates a particularly wide range of glazing panels with the same general esthetic appearance.

The movable sash 54 of the window structure 10 includes the head extrusion 86, the jamb extrusions 88, shown better in cross section in FIG. 49, and the sill extrusion 90, shown better in cross section in FIG. 67. As shown better in FIG. 2, the window sash 54 may be pivoted about the bottom thereof to provide a hopper window in place of the conventional single hung window with the window frame 12 in a vertical position. With the window structure 10 in the position shown in FIG. 3, the sash 54 is movable horizontally to provide a glider window. When used as a glider window, the window structure 10 may be installed as either a right or left glider. Thus, the window structure 10 cannot be installed upside down as a glider window.

Figure 14:
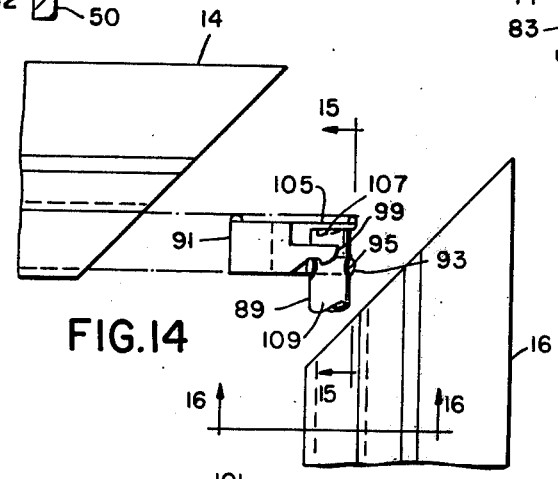
FIG. 14 is an enlarged exploded elevation view of the upper right corner of the window structure of FIG. 1 illustrating the sash balance mounting insert in relation to a sash balance and the window frame.
Figure 15:
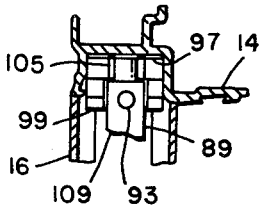
FIG. 15 is a section view of a portion of the head and jamb extrusions of the window structure of FIG. 1 illustrating the sash balance and sash balance mounting insert in assembly therewith taken substantially on the line 15—15 in FIG. 14.
Figure 16:
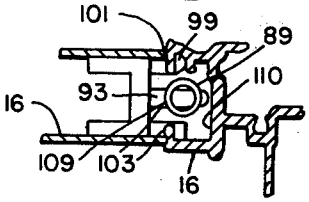
FIG. 16 is a section view of a portion of or head and jamb extrusions of the window structure of FIG. 1 illustrating the sash balance and sash balance mounting insert in assembly therewith taken substantially on the line 16—16 in FIG. 14.
Figure 17:
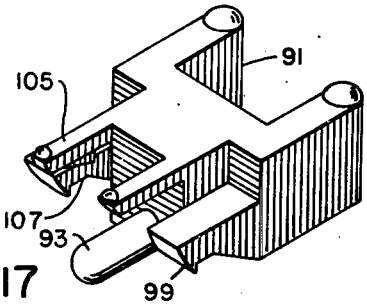
FIG. 17 is an enlarged perspective view of the sash balance mounting insert illustrated in FIGS. 8 and 14 through 16.

A sash balance such as the sash balance structure 89 of FIG. 14 is not necessary in the window structure 10 when used as a glider window as in FIG. 3. Further, sash balance structure is not essential with lighter window sash 54 with the window structure 10 used as a single hung window as in FIG. 1 or as a hopper window as in FIG. 20. The securing of sash balance structure 89 to the frame jambs 16 of the window structure 10 during initial assembly of the window structure 10 requires separate windows to be inventoried depending on the ultimate use of the windows. Alternatively, the securing of the separate sash balance structure 89 to the window structure 10 may be accomplished in the field by screws or the like as shown in FIG. 1. Heavy inventories and field assembly of sash balance structure is objectionable. Therefore, a sash balance supporting insert 91 shown in perspective in FIG. 17 and illustrated in assembly with the sash balance structure 89 and positioned in the frame head and frame jamb extrusions 14 and 16 respectively in FIGS. 14 through 16 is provided to make one window structure 10 universally usable without objectionable field assembly of sash balance structure.

As illustrated in FIG. 14, the sash balance structure 89 is supported by the projection 93 on the insert 91 extending through the opening 95 in the sash balance structure 89. The insert 91 with the sash balance structure 89 held thereon by the thin fins 107 extending into the hollow tube 109 of the sash balance structure is placed in the pocket 97 in the frame head extrusion 14 and is moved toward the jamb extrusion 16 until the barb portions 99 of the insert 91 cam over the portions 101 and 103 of the jamb extrusion 16 cross section to lock the insert 91 in position. Camming of the barb portions 99 over the portions 101 and 103 of the jamb extrusions 16 is permitted due to flexing of the portions 106 of the insert 91. With the barbs positioned over the portions 101 and 103 of the jamb extrusion 16, the sash balance assembly 89 is supported in the pocket 110 in the jamb extrusion 16 as shown, for example, in FIG. 16.

The sash 54 is guided at the bottom in the position illustrated in FIG. 2 for movement vertically in the plane of the frame 12 by the pivot structure 92 illustrated best in FIGS. 18, 19 and 20. The pivot structure 92 also permits tilting of the sash 54 about the bottom thereof into the hopper window position illustrated in FIG. 2. Further, the pivot structure 92 is constructed of two separate parts 94 and 96 which are disengageable to permit removing of the movable sash 54 from the frame 12 of the window structure 10 as desired.

The part 94 illustrated best in FIG. 20 includes a generally rectangular portion 98, a generally cylindrical portion 100 and an intermediate flange 102. A countersunk screw opening 104 extends through the part 94 to permit mounting of the part 94 in the sash jamb recess 106 as illustrated particularly in FIG. 18. With the part 94 installed in each sash jamb extrusion 88 adjacent the bottom thereof, the flange 102 provides sliding engagement with the frame jamb 16 on movement of the sash 54 relative to the frame 12. The mounting screw for the part 94 extends into a screw runner 106 in the sash sill extrusion 90 illustrated best in FIG. 67 for assembly of the sash 54.

With or without the part 96, the part 94 provides a pivot mounting and guide for the sash 54. The part 96 is used in conjunction with a sash balance tape 120 of sash balance structure 89. The part 96 in assembly is positioned in the pocket 110 formed in the frame jamb extrusion 16 and receives the elliptical end 100 of the part 94 in the recess 112 therein. The recess 112 is open on two sides as shown best in FIG. 19 to allow the end 100 of the part 94 to engage the edges 28 of the pocket 110 of the frame jamb 16 with the sash 54 in a pivoted or hopper position and thus prevent further sliding action of sash 54 with or without balance structure 89. The same camming or locking action on pivoting of the sash 54 will occur without the member 96.

In addition, the part 96 is provided with the recesses 114 and 116 connected by the transverse slot 118 as shown in FIG. 18 to permit connection of the spiral tape 120 of sash balance structure 89 having the offset end 112 to the part 96 on insertion of the offset end 122 through the slot 118, as shown best in FIGS. 18 and 19. The part 96 of the pivot structure 92 is thus readily removed from or installed on the tape 120 of the sash balance structure 108 without the use of any mechanical connectors. However, accidental removal of the member 96 from the sash balance structure 89 is substantially impossible with the sash 54 installed, since initial tilting of the top of the member 96 toward the sash 54 is required for the removal of the member 96 from the tape 120.

Flanges 124 on the part 96 as shown in FIG. 19 provide frictional engagement of the member 96 with the edge 128 of the pocket 110 in the frame jamb 16 when the part 94 is removed from the recess 112 of the part 96 to remove the sash 54 from the window structure 10. The frictional engagement is produced by the torsion in the sash balance tape 120 and causes the part 96 to be held in a fixed position when the sash 54 is removed from the frame 12 to facilitate replacing of the sash 54. To prevent the top of part 96 from coming out of the pocket 110 when the sash 54 is removed, a ridge 111 is provided on part 96 to engage the edge 128 of pocket 110.

The member 94 may be replaced by the modified pivot member 117 illustrated in FIG. 21, particularly in installations wherein the removal and replacement of the sash 54 is frequent. The member 117 includes a bottom extension 119 on the central flange 121 thereof which permits square cutting of the bottom of the sash jambs with no possible damage to the sealing strips 242 or 280 illustrated in FIGS. 49 and 50 which might occur if the rounded bottom extension 119 were not provided. Member 117 further includes the extension 121 and the flanges 123 engageable with the edge 136 of the pocket 106 which prevent movement of the member 117 from an installed position into pocket 106, thus impairing removal or tilting of the sash 54. Extension 121 and flanges 123 also space the metal of the sash 54 from the metal of the frame 12. Again, it will be understood that the member 117 may be used without the member 96 if no sash balance is provided in a window structure 10.

In the modified pivot structure of FIG. 22, the pivot member 130 is provided with longitudinally extending grooves 134 on the opposite sides thereof which are press fit onto the edges 136 of the pocket 106 of the sash jamb extrusion 88 to retain the pivot member 130 in position adjacent the bottom of the sash 56. A cylindrical portion 138 extends outwardly of the pivot member 130 to receive the end 140 of the spring type sash balance structure 142 as shown in FIG. 22. A retaining head portion 144 is connected to the cylindrical portion 138 of the pivot member 130 and prevents slipping of the end 140 of the spring type sash balance structure 142 off of the cylindrical portion 138 of the pivot member 130 in assembly. Again, the same pivot member 130 extending into the pocket 110 in the frame jamb 16 permits pivoting of the sash 54 when no balance structure 142 is connected thereto. A torsion type balance structure such as balance structure 89 with the end of the tape 120 wrapped around cylindical portion 138 of pivot member 130 may be used in place of sash balance structure 142 if desired.

To permit ready removal of the sash 54 when sash balance structure 89 or 142 is used, an additional pivot member 146 is provided in the pivot structure shown in FIG. 23. The member 146 has the opening 150 therein through which the end 140 of the spring of sash balance structure 142 extends. The member 146 also has the opening 152 extending therethrough through which the head 144 of the pivot member 132 extends with the members 132 and 146 in assembly as shown in FIG. 23. The opening 152 has a larger upper portion, as shown in FIG. 23, to permit disengagement of the pivot member 132 and 146 when the members 132 and 146 are pivoted at right angles to each other with respect to the position thereof illustrated in FIG. 23.

It will be seen that in the modified structure of FIG. 23, the member 132 is provided with a head portion 144 turned at right angles to the head portion of the member 130 of FIG. 22 to secure pivot member 146 in assembly therewith with greater facility when sash 54 is in a closed position. Also, a larger rectangular portion 154 is provided on pivot member 132 in FIG. 23 to stabilize the position of the pivot member 132 in the sash jamb 88.

In the modified pivot structure of FIG. 24, the pivot member 156 is provided with a vertically extending flange 158 located axially inwardly of the flange 102 with respect to the pivot part 94 illustrated in FIG. 20. The pivot part 156 illustrated in FIG. 24 is thus more stablely secured in the sash jamb 88. Part 94 is between the part 96 and the part 117 in development. The pivot structures of FIGS. 22 and 23 are previous to pivot structure 92.

The guide structure 160 illustrated particularly in FIG. 25 is provided at the top of the sash 54 on both sides thereof. The guide structure 160 guides the top of the sash 54 at both upper corners thereof in vertical movement within the frame 12. Guide structure 160 may be released to permit pivoting of the sash 54 to the position indicated in FIG. 2 to provide a hopper window.

In particular, the guide structure 160 includes the member 162 illustrated best in FIG. 26 and the member 164 illustrated best in FIG. 27. In assembly as shown in FIG. 25, the portion 166 of the member 162 is positioned in the pocket 106 in the sash jamb member 88 and a screw is provided extending centrally through the part 166 of member 162 through the jamb extrusion 88 and into a screw runner in the sash head extrusion 86 to secure the member 162 to the sash 54 at an upper corner thereof with the bottoms of the projections 170 in engagement with the top of the head extrusion 86 of the sash. An opening is thus provided between the upper part of portion 166 of the member 162 and the projections 170 to receive the central cylindrical portion 172 of the member 164 for rotation.

The member 164 is thus secured to an upper corner of the sash 54 and may be rotated about the longitudinal axis of the central cylindrical portion 172 thereof to place the transversely extending locking portion 174 thereof in the pocket 176 provided in the jamb adaptor extrusion 20. In this position of the locking portion 174 of the member 164, the sash 54 is guided in vertical movement and prevented from pivoting out of the plane of the window frame 12. In such vertical movement, the upper edge of the sash jamb extension 88 is spaced from the frame jamb extrusion 16 by the pads 178 provided on the portion 166 of the member 162 as shown best in FIG. 25.

When it is desired to pivot the sash 54 into a position such as that shown in FIG. 2, the handle portion 177 of the member 164 may be grasped and the member 164 rotated to remove the locking portion 174 from the pocket 176 permitting desired tilting of the sash 54.

Other guiding and tilt release structure may be provided in conjunction with the sash 54 and frame jamb extrusion 16 as shown in FIGS. 28 through 39. In FIG. 28, a simple bolt 180 is guided in movement toward and away from the frame jamb member 16 by the guide 182 secured to the top of the head extrusion 86 of the sash 54 through which the bolt 180 extends. A guiding portion 184 is provided on one end of the bolt 180 adapted to be positioned in the pocket 110 in the frame jamb 16 or removed therefrom on movement of the bolt 180 by grasping the bolt head 186 provided on the opposite end of the bolt 180.

Alternatively and as best shown in FIG. 29, a fixed guiding member 188 similar to members 162 and 164 secured together in a sash restraining configuration may be secured to the sash 54 adjacent the top thereof on each side by convenient means and a cooperating notch 192 provided in the jamb adaptor extrusion 20 at a different elevation on opposite sides of the window structure 10. Each side of the sash 54 may then be tilted outwardly of the frame at a different elevation to permit tilting of the sash 54 into the hopper position without danger of accidental tilting thereof. Such structure has the advantage of being particularly simple.

The guiding structure 194 illustrated in FIGS. 30 through 32 includes a member 196 having the generally triangular portion 198 and the handle portion 200. The member 196 is in assembly fastened to the top of the sash 54 adjacent the end thereof by the pivot structure 202 which may be a rivet or bolt allowing pivoting of the member 196 thereabout into the positions shown in FIGS. 30, 31 and 32. Detent means 204 may be provided as shown associated with each position of the member 196. The member 196 may be a half an inch in dimension vertically of the window structure 10.

In the position illustrated in FIG. 30, pivotal movement of the sash 54 with respect to the frame jamb 16 is prevented due to the engagement of the one end of the portion 198 of member 196 with the frame jamb extrusion 16. The one end of the portion 198 of the member 196 in the position illustrated in FIG. 30 thus guides the sash 54 in vertical movement in the jamb 16. As shown in the position of FIG. 31, the member 196 permits pivoting of the sash 54 out of the plane of the frame 12 as shown in FIG. 2. Pivoted further as shown in FIG. 32, the other end of the member 196 extends through the slot 208 in the frame check rail extrusion 22 to prevent movement of the sash 54 up and down and thus lock the sash in the closed position.

In the modification illustrated in FIGS. 33 through 36, the sash guiding and tile release structure 181 includes a separate bolt 183, illustrated best in FIG. 36, and a separate bolt guiding member 185. With the bolt guiding member 185 secured to the window sash 54 at an upper corner thereof, the bolt member 183 may be inserted therethrough and into the pocket 110 of the frame jamb 16.

With end 187 of bolt 183 extending into the pocket 110, the bolt member 183 will provide frictional engagement with the frame jamb member 16 so that the bolt member 183 may replace both sash balances or may maintain the sash 54 in a square relation to the frame 12 so that only a single sash balance is necessary in the window structure 10.

With the bolt 183 extending through the guiding member 185 in the opposite direction so that the end 189 extends into the pocket 110 in the frame jamb member 16, the sash 54 is again maintained square with the frame 12 and is also permitted vertical or horizontal movement with minimum sliding contact between the frame jamb and window sash 54. In this position, the bolt 183 also allows easy tilt release of the window sash 54 and a snap-lock feature on return of the window sash 54 to a vertical position.

With either end of bolt 183 engaged with the frame jamb member 16 and with the sash slightly tilted into the hopper position, ventilation with the window locked can be obtained in either of the single hung or glider positions of window structure 10.

The guiding member 185 as shown in detail in FIG. 35 includes a hollow rectangular portion 191 through which the bolt member 183 is received. The hollow rectangular portion 191 is secured to a rectangular portion 193 adapted to fit within the pocket 106 in the jamb member of the sash 54 at the top thereof. The rectangular portion 193 has a countersunk opening 195 therethrough which a bolt extends into the screw runner groove in the head member of the sash 54 to secure the guiding member 185 to the sash 54 at the upper corner thereof. A flange 197 is provided on the guiding member 185 which engages the edge of the pocket 106 and provides a metal to plastic sliding surface between the sash 54 and the frame 12.

The end 187 of bolt 183 is bifurcated to provide an axial slot 199 having a tapered open end 201. The slot 199 may be varied in width, but preferably in depth, to provide calibrated friction engagement of the surfaces 205 on opposite sides of the end 187 of bolt 183 with the edge of the pocket 110 in the frame jamb 16. The end 187 of the bolt 183 is thus maintained as rigid as possible while permitting a wide variation in possible frictional engagement with the frame jamb 16. Due to the variation in frictional engagement with the frame jamb 16 possible due to the provision of the slot 199, the bolt 183 with the end 187 inserted in the pocket 110 may replace one or both sash balance structures in the window structure 10 in lighter and more economical windows.

The open ends of the slots 199 and 219 permits securing the window sash 54 in a slightly tilted position wherein the portion 207 of the frame jamb extrusion 16 is in the tapered open end of the slots. The sash 54 may thus be locked in a ventilating position.

The tapered portions 209 and 211 of the end 187 of the bolt 183 guide the bolt 183 into the pocket 110 in the frame jamb member 16 and the tapered portion 213 of the end 187 of bolt 183 prevents movement of the end 187 of bolt 183 out of the pocket 110 accidentally. Abutments 215 prevent insertion of the end 187 of the bolt 183 too far into the pocket 110 of the frame jamb 16, and the taper 217 immediately behind the abutments 215 prevent accidental disengagement of the bolt 183 from the guiding member 185.

The bolt 183 may be assembled with the guiding member 185 by placing a screwdriver or similar object in the slot 219 in the end 189 of the bolt 183 and spreading the end 189 with the screwdriver, which action will cause the sides of the slot 199 in the end 187 to converge and therefore permit insertion of the bolt 183 through the guiding member 185. The bolt 183 may thus be assembled with the guiding member 185 with either the end 187 or the end 189 adjacent the frame jamb 16.

With the end 189 of bolt 183 adjacent the frame jamb 16, the end 189 of the bolt 183 may be inserted in the pocket 110 in the frame jamb 16 on movement of the bolt projection 221 toward the jamb 16. The taper 223 on the end 189 prevents accidental movement of the end 189 of the bolt 183 from the frame jamb 16. Abutments 225 provide minimum sliding contact between the bolt 183 and the frame jamb 16 with the end 189 of the bolt 183 in the pocket 110 in the frame jamb 16. In use, the end 189 of the bolt 183 is urged toward the frame jamb 16 due to the tapered camming surface 227 on end 189 of the bolt 183 which acts in conjunction with the guiding member 185 to resiliently urge the bolt 183 toward the frame jamb 16.

When the end 189 of the bolt 183 is positioned adjacent the frame jamb 16, snap closing of the sash 54 from the tilted hopper position thereof is provided due to the reduced length of the projection 229 and the cam surface 231 on the end 189 of the bolt 183. Thus, on pivotal movement of the sash 54 toward the frame 12, the end of the projection 220 just barely clears the frame jamb 16 so that the bolt 183 is cammed away from the frame jamb 16 as the sash 54 is moved into the vertical position by surface 231. At this time the bolt 183 is pring loaded due to movement of the camming surface 227 into the guiding member 185 permitted by flexture of the end 189 of the bolt 183 due to the provision of the slot 219 therein. As the point 233 of the end 189 passes the edge of the pocket 110 on pivotal movement of the sash 54 into the closed position, the end 189 of the bolt 183 is snapped into the guiding position wherein the edge of the pocket 110 of the frame jamb 16 is held against the abutment surfaces 225.

The guiding and tilt release structure of FIGS. 37 through 39 again includes a bolt member 210 adapted to extend through an opening 212 in a guide member 214 secured to the top of the window sash 54. As shown in FIG. 37, with the end 216 of the bolt 210 extending into the pocket 110 of the frame jamb 16, the sash 54 is guided in vertical movement and is prevented from tilting with respect to the window frame 12. Further, since the end 216 of the bolt 210 is bifurcated as shown and a slight taper is provided on the sides thereof, the end 216 of the bolt 210 provides greater or less frictional engagement with the edges of the pocket 110 in accordance with the degree of insertion of the end 216 of the bolt 210 into the pocket 110 and is a ready substitute for a sash balance on windows of moderate weight. The serrations 218 on the bolt 210 cooperate with similar serrations on the inside of the opening 212 in the guide member 214 to maintain the bolt 210 in a set position. The frictional engagement of the bolt 210 with the frame 16 may be varied to counterbalance the weight of the sash as desired by varying the depth of insertion of end 216 in pocket 110 or preferably by varying the depth of slot 217 in bolt 210 while maintaining the bolt as stiff as possible to reduce flexture thereof.

With the bolt 210 turned in the opposite direction and inserted through the opening 212 in the guide member 214 as shown best in FIG. 38, no counterbalancing function is provided by the bolt member 210. The bolt 210 then guides the window sash 54 in its vertical movement in the frame 12 and spaces the sash 54 from the frame 12.

The bolt member 210 of the guiding structure illustrated in FIGS. 36 through 38 has a separate function when the window sash 54 is tilted as for example into the position illustrated in FIG. 2. In such case, the bolt 210 is removed from the guide member 214 and the end 216 is secured around the sash jamb member 88 as shown in FIG. 39 and the projection 220 on the bolt 210 is inserted in the pocket 110 of the frame jamb 16 to secure the sash 54 at a particular tilted angle. The angle of tilt may, of course, be changed by moving the bolt 210 in the position illustrated in FIG. 39 vertically of the sash 54. Bolt 210 may thus be a substitute for the separate hopper lock members illustrated in FIGS. 40 through 46.

The hopper lock member 241 illustrated in FIGS. 40, 41 and 42 includes the end 243 adapted to be inserted in the pocket 110 of the frame jamb 16 and the end 245 adapted to be inserted in the pocket 106 in the jamb of the sash 54 secured together by the elongated strap central portion 247 which is sufficiently wide to prevent the hopper lock 241 from going into either of the pockets 106 or 110 in assembly.

The end 243 of the hopper lock 241 snaps into the pocket 110 and is held therein by the shoulder 249 extending therearound. As shown, the end 243 has the opening 251 extending therethrough and is split at 253. Since the end 243 is split at 253 and is oversize in the frame jamb pocket 110, the end 243 is under stress in the pocket 110 and thus slides in the pocket 110 less readily than the end 245 of the hopper lock 241 which is under little or no stress. To insure greater friction between the sash jamb 16 and the end 243 of the hopper lock 241 with the sash in an untilted position, ribs 255 are provided on the end 243 in the position shown so that the friction is present when the sash 54 is in a closed position.

The end 245 is again slightly oversize in the pocket 106 in the jamb of the sash 54, snaps in the pocket 106 and is held in the pocket by the shoulder 257. The tapered sides 259 of the end 245 of hopper lock 241 limit relative movement between the hopper lock 241 and sash 54 with the hopper lock installed on either side of the sash 54. Thus, the hopper lock 241 never rotates relative to the sash on tilting of the sash into a hopper position to such an extent that the hopper lock 241 will bind when the sash 254 is tilted back into the closed position. The hopper lock always maintains an angle of at least 45 degrees with respect to the window sash 54 with the end 245 always being above the end 243.

A tapered radius 261 is provided on the strap portion of the hopper lock 241 adjacent the end 245 as shown in FIGS. 40 and 41. The radius 261 urges the end 243 of the hopper lock 241 into pocket 110 in the frame jamb 16 on pivoting of sash 54 into the hopper position to help prevent accidental disengagement of the hopper lock.

Due to the greater frictional engagement of the end 243 with the frame jamb 16 in relation to the frictional engagement of the end 245 of the hopper lock 241 with the window sash 54, the hopper lock member 241 will be retained in an upper or minimum ventilation position on movement of the sash 54 up with the window in use as a single hung window. Thus, the hopper lock 241 is moved upward by engagememnt of the end 245 thereof with the pivot structure at the bottom of the sash 54 on raising of the sash 54. On subsequent lowering of the sash 54, the hopper lock 241 remains in the raised position thereof in the frame 12 while the sash 54 is lowered with the sash sliding relative to the end 245 of the hopper lock 241 which is retained in a raised position by the frame jamb 16. Thus, after raising the sash 54, accidental total pivoting of the sash 54 about the bottom thereof is prevented by the hopper lock 241.

A similar hopper lock or tilt link 222 for maintaining the pivoted sash 54 at a predetermined angle, which angle may be varied, as illustrated in FIG. 43. The hopper lock 222 as shown in FIG. 43 includes an elongated strap central portion 224 terminating in a portion 226 extending at right angles thereto at one end thereof and concentric disc portions 228 and 230 at the opposite end thereof.

In the modification of the hopper lock 222 illustrated in FIG. 44 the outer, larger diameter, disc 230 is only partial to facilitate insertion thereof into pocket 106 in sash jamb 88. In FIG. 45 a projection 234 is provided on the partial disc portion 230 to more easily retain the hopper lock end in the pocket 106. In the modified structure of FIG. 46, flanges 238 are provided at each side of the strap portion 224 of the hopper lock 222 to increase the rigidity thereof and to provide a pocket 240 to more positively hold the edge of the frame pocket 110.

In use, the hopper lock 222 or any of the modifications thereof may be stored in the pocket 106 in the sash jamb members 88 and when the sash 54 is tilted, the hopper lock 22 is exposed whereby the end portion 226 may be grasped and the hopper lock 222 pivoted to a horizontal position and the end 226 inserted in the pocket 110 of the frame jamb 16 to hold the sash 54 in a tilted position which may be varied again on movement of the hopper lock 222 vertically of the frame 12. The disc portion 228 provides a bearing on the edge of pocket 106.

To prevent hurricane strength winds from separating the sash jamb 88 from the frame jamb 66, hurricane clips 246 as shown in FIG. 48 have been provided extending between the frame jambs and sash jambs. The hurricane clips 246 are positioned in the pockets 106 in the sash jamb extrusions 88 and are urged outwardly thereof into the pockets 110 in the frame jamb extrusions 16 by the springs 248 as shown in FIG. 47. The hurricane clips 246 extend for the full distance between the edges of the pocket 106 and include a flange 150 extending on each side thereof in engagement with each edge of the pocket 106 to retain the clips 246 in the pockets 106.

The hurricane clips 246 may be moved along the length of the sash jamb members 88 as needed to provide added strength of the jamb extrusions 88 in assembly with the frame extrusions 16. With the hurricane clips 246 in position in a window sash 54, tilting of the window sash may be accomplished on movement of the sash vertically until a sash balance engages the hurricane clip 246 to force it back into the pocket 106. Alternatively a knife may be slipped between the sash jamb member 88 and the frame jamb member 16 and moved vertically into engagement with a cam surface 236 on the hurricane clip 246 to cam the hurricane clip 246 back into the pocket 106 to permit pivoting of the sash 54 as before.

When the sash is not in the pivoted position illustrated in FIG. 2; that is, when it is in the position illustrated in FIG. 1, the sash jamb extrusion 88 engages the plastic sealing strip 242 which is secured in the recess 244 in the frame jamb member 16 and extends between the frame check rail and frame sill as shown best in FIG. 49. With the sealing strip 242 constructed with the cross section shown in FIG. 49, the seal provided thereby with the window sash 54 in the closed position is particularly tight and will become tighter as wind force increases on the outside of the window structure 10 until the wind pressure is so great as to cause separation of the frame jamb member 16 and the sash jamb member 88 due to different bending strengths thereof.

Due to the mitered lower corners of the sash frame and the profile of the frame sill member 18 as compared to the frame jamb members 16, a small triangular opening is provided at each lowered mitered corner of the window structure which with sealing strip 242 is objectionable since air leakage may occur through the small triangular opening. Corner inserts 250 as shown best in FIG. 55 have therefore been provided at each mitered lower corner of the window structure 10 to seal the triangular opening and provide excellent wind tightness for the window structure 10.

As shown in FIG. 55, the corner insert includes the generally triangular portions 252, the lower edge of which is adapted to seat on the frame sill member 18 at the mitered end thereof as shown in FIG. 57. The extension 254 then extends within the pocket 110 of the frame jamb member 16 as shown in FIG. 56 with the corner insert 250 in assembly as shown in FIG. 54.

Alternate corner clips 256, 258 and 260 for sealing the same triangular opening between the sill extrusion 18 and the jamb extrusion 16 at the mitered connection therebetween are shown in FIGS. 58, 61 and 64 and are illustrated in assembly with the frame jamb members 16 in FIGS. 59, 62 and 65. The corner inserts 256, 258 and 260 are illustrated in assembly with the frame sill extrusions 18 in FIGS. 60, 63 and 66 respectively.

The insert 258 is provided with the two sloping surfaces 262 and 266 rather than sloping surfaces on opposite sides thereof as in the case of the insert 250. Both the inserts 250 and 258 may be used at either side of the window structure 10 as is the case of all of the hardware for the window structure 10 including the previously discussed pivot structure, guiding structure, and hopper lock member, all of which are made of suitable plastic material.

The corner insert 256 again has sloping surfaces 268 and 270 as is the case with the insert 258. However, instead of the rectangular positioning portion 272 provided with the insert 258, the insert 256 is secured to the jamb extrusion 16 by means of the spaced apart extensions 272 and 271 extending over a portion of the jamb extrusion at one side of the pocket 110. The portion 273 of insert 256 aids in securing a screen to the frame 12 over the opening for sash 54.

Similarly, the insert 260 has the separate extensions 274 and 276 adapted to fit on both sides of one side of the pocket 110 in the extrusion 16. Insert 260 is again, due to its symmetry, suitable for use on either side of the window structure and is located on the frame sill member 18 by means of the ribs 278 thereon.

When the modified sealing strip 280 of FIG. 50 is used in the window structure 10, the triangular opening between the sill extrusion 18 and the jamb extrusion 16 of the frame 12 is covered by the sealing strip 280 and therefore no corner inserts are necessary. The modified sealing strip 280 fits over the projections 282 and 284 on the jamb extrusions 16 as shown in FIG. 50 and provides a particularly tight weather seal which is not readily damaged on removal and reassembly of the sash 54 in the frame 12. Sealing strip 280 is constructed of plastic of different hardness. Thus, the part 281 is relatively hard while the part 283 is relatively soft.

The screen retaining clip 271 illustrated in FIG. 51 is carried by the sealing strip 280. Screen clip 271 is adapted to receive the frame of the screen 273 between the legs 275 and 277 of the U-shaped portion thereof in assembly therewith. An open returned portion 279 of clip 271 is placed over the flange 281 of the harder portion of the sealing strip 280 to secure the screen clip 271 to the sealing strip.

In installation a screen 273, as shown best in FIG. 1, is inserted in the clips 271 secured to the sealing strip 280 and moved to the top of the opening to be covered by the screen. The bottom of the screen 273 is then pivoted about the top thereof toward the sill extrusion 18 and is allowed to drop behind the vertical flange 283 on the sill extrusion 18. The clips 271 which are provided at each jamb of the window frame 12 are then moved down so that they are substantially centrally located along the frame jambs in the window opening covered by the screen. The screen 273 is thus securely held in place by two screen clips 271 and may be easily removed and replaced in the window structure 10.

The modified screen retaining clip 285 illustrated in FIGS. 52 and 53 includes a portion 287 for securing the clip 285 to the jamb extrusion 16 of the window structure 10, a handle portion 289 to facilitate moving of the screen clip 285 along the jamb extrusion 16 of the window structure 10 and the connecting portion 291 extending between the portions 287 and 289 and cooperable therewith to receive the frame of the screen 273 and secure the screen to the window structure 10. In particular the tabs 293 of the portion 287 of the screen clip 285 extend over the frame of the screen 273 to hold it in assembly with the clip 285. The clip 285 is in turn secured to the window structure 10 by means of the tab 295 extending from the frame jamb extrusions 16 over the portion 297 of the screen clip 285 as shown best in FIG. 52. The clip 285 has the advantage of being secured directly to the frame jamb 16 rather than to the sealing strip 280 whereby the flange 299 illustrated on the sealing strip in FIG. 51 is not necessary when the clip 285 is used.

With the sash 54 in a down position in the plane of the frame 12; that is, when the sash sill extrusion 90 rests on the sill 18 of the frame 12, as shown in FIG. 67, locking structure 286 is provided to lock the sash 54 in its down position. Locking structure 286 includes the locking member 290 illustrated in perspective in FIG. 68 which is received in the longitudinally extending pocket 292 in the sash sill extrusion 90 and the spring 294 urging the locking member 290 into the locked position wherein the barb portion 296 thereof engages the barb projection 298 on the frame sill extrusion 18. The locking member 290 pivots about the inner edge of flange 300 in opposition to the bias of the spring 294 to permit releasing the locking member 290 from the frame sill projection 298. Engagement of the portion 302 of the locking member 290 with the surface of the pocket 292 prevents removal of the locking member 290 from pocket 292 with the sash 54 in a raised position due to the bias of the spring 294.

Alternatively, the locking structure 308 including locking member 304 biased by the leaf spring 306 may be positioned in the pocket 292. The locking member 304 and spring 306 function in substantially the same manner as the locking structure 286 and in addition may be gravity latched since the member 304 tends to assume the latched position thereof as illustrated in FIG. 69 without the spring 306.

The modified locking structure 310 illustrated in FIG. 70 includes locking member 314 and the separate lock surround member 312 illustrated in FIGS. 71 and 72 respectvely and the spring 316 operable therebetween.

The lock surround member 312 includes the generally rectangular portion 320 adapted to fit within the sash sill extrusion 90 as shown in FIG. 70 and the portions 322 and 324 integral the ends of the lock surround member 312 and projecting outwardly from the sash sill extrusion 90 and downwardly therefrom to engage the portion 326 of the frame sill member 18 in the slots 328 therein as the sash 54 having the lock surround member 312 installed in the sill extrusion 90 thereof is lowered. Thus, the locking member 314 positioned between the portions 322 and 324 of the lock surround member 312 is always aligned with the portion 326 of the frame sill extrusion 18 to insure engagement of the barb projection 330 on the locking member 314 with the barb projection 298 on the frame sill extrusion 18. Also, the lock surround member 312 prevents outward movement of the sill 90 of sash 54 to disengage the locking member 314 and thus provides a lock safety feature.

As before, the locking member 314 is pivoted about the inner edge of the flange 300 of the sash sill extrusion 90 and is maintained in pivotal relation with the inner edge of the flange 300 by means of the longitudinally extending portions 332 and 334 of the locking member 314. The spring 316 is received in the recess 336 in the locking member 314 and tends to pivot the locking member 314 out of the sash sill extrusion 318 while such movement of the locking member 314 is prevented due to engagement of the extensions 338 of the locking member 314 with the abutment portions 340 on the lock surround member 320.

All of the locking structures 286, 308 and 310 may be moved longitudinally of the sill extrusion 90 of the window structure 10 within the pocket 292 to any desired position thereof permitting advantageous location of the locking structure when the window structure 10 is used as a glider window as illustrated in FIG. 3. Advantageous location of the locking structure also permits avoiding of drapes and the like with the locking structure when the window is used as a single hung window.

As shown best in FIGS. 2 and 3, the glazing panels 50 and 52 of the window structure 10 are apparently divided into smaller window panes by the false muntin structure 350 including false muntin members 352 and false muntin member retaining clips 364. The false muntin members 352 are, however, provided on one side of the glazing panels 50 and 52 only and therefore do not require division of the glazing panels 50 and 52 into smaller panes as in the past. In addition, the false muntin structure 352 is readily removable from the window structure 10 and replaceable thereon to facilitate cleaning of the glazing panels 50 and 52. The esthetic appearance of small glass panes may thus be obtained in the window structure 10 without the added expense of mulling the small panes and maintenance of the window structure 10 is facilitated through the use of the false muntin structure 350, which false muntin structure requires a minimum amount of fabrication and does not come apart accidentally in use.

More specifically, the muntin members 352 are hollow and have the cross section illustrated in FIG. 76. The muntin members 352 are provided with a notch 354 centrally thereof extending halfway through the members to permit assembly of two false muntin members by means of the cross shape interlocking member 356 illustrated in perspective in FIG. 75. With two false muntin bars 352 connected as illustrated in FIG. 3, the cylindrical end portions 358 of the interlocking member 356 are received in the longitudinally extending channels 360 of the false muntin members 352 which extend at right angles to each other with the muntin members in assembly. With two muntin members 352 extending at right angles to each other with the notch 354 in one receiving the notch 354 of the other, the false muntin members 352 are in the same plane so that flanges 362 on the false muntin members 352 provide strength and rigidity for the connected false muntin members 352 as well as giving a finished appearance thereto.

To assemble two false muntin members 352 having notches 354 therein, an interlocking member 356 constructed as illustrated in FIG. 72 is first positioned in one false muntin member 352 with the cylindrical projections 358 on one portion of the cross-shaped interlocking member positioned within the longitudinal channels 360 of the one false muntin member 352. The other portion of the interlocking member will thus extend perpendicular to the longitudinal extent of the one false muntin member and should be centered in the notch 354. The one false muntin member is then positioned perpendicular to a second false muntin member with the notches 354 therein substantially aligned as shown in FIG. 71 and one of the cylindrical portions 358 on the portion of the interlocking member extending at right angles to the one false muntin member is urged into the notch 354 and channel 360 in the other false muntin member 352, while the one false muntin member 352 is rotated slightly to permit sliding of the one false muntin member longitudinally of the other false muntin member past the notch therein to permit snapping of the remaining cylindrical portion 358 of the interlocking member 356 into the notch of the other false muntin member. On movement of the one false muntin member back over the notch 354 in the other false muntin member, the notch of the one false muntin member is drawn into the notch of the other false muntin member by the elasticity of the plastic interlocking member 356 to form a completed connection between the false muntin members 352 as illustrated in FIG. 73. On reversal of this procedure, the false muntion members 352 may be disconnected.

The retaining clips 364 may be used to secure the false muntin members 352 to the frame 12 of the window structure 10 and to the sash 54 of the window structure 10. The retaining clip 364 which is universal; that is, may be used with either wood or metal frames and with hollow or solid false muntin members of different thicknesses, includes the central abutment portion 368 against which the end of a false muntin member 364 may be abutted and which in turn abuts the frame or sash of the window structure 10. The structure 370 extends from one side of the abutment portion 368 to secure the retaining clip to the frame or sash and the structure 372 extends from the other side of the abutting portion of the retaining clip 364 for securing the false muntin member to the retaining clip.

As shown, the structure 370 for securing the retaining clip 364 to the window frame or window sash includes two triangular portions 374, one at each end of the abutment portion 368 of the clip 364 and extending outwardly of and beyond the clip 364, as shown best in FIG. 78. In addition, the triangular portions 374 of the clip 364 are provided with serrations 378. In use, the triangular portions 374 of the clip 364 are forced between the frame or sash and glazing panel positioned therein and are retained in position between the frame or sash and glazing panel by engagement of the serrations 374 with the frame or sash in the case of wood window construction. In the case of metal window construction such as the window structure 10, the inclined portions of the triangular portions 374 of clips 376 extend behind retaining beads or the glazing strips 56 on the frame 12 or sash 54 to secure the retaining clips 364 in position.

The retaining clips 364 are then moved along the edge of the glazing panel until they are positioned correctly to receive the ends of the false muntin structure 350 at which time the ends of the false muntin members 352 of the false muntin structure 350 are forced into the retaining clips 364 by spreading parts 380 and 382 of the portion 372 of the clip 364 apart. As shown best in FIG. 79, the parts 380 and 382 include two or more separate notches 384 and 386 therein to accommodate false muntin members 352 having different thicknesses.

The modified retaining clip 388 shown in FIG. 77 includes the relatively thin semi-circular portion 390 which may be serrated and is adapted to be inserted between the frame or sash and a glazing panel or glazing strip and which has the cut and bent-out barb 392 positioned centrally thereof for retaining the clip 390 in the window structure 10. Clip 388 is thus universal as is clip 364.

The retaining clips 394, 396 and 398 illustrated in FIGS. 81, 82 and 83 are further possible modifications of the universal retaining clips 364 and 390. The retaining clip 394 includes a single barb portion 400 which is relatively thin and serrated so that the retaining clip 394 is particularly suited for use with wood window construction. In contrast, the retaining clip 396 is provided with a single triangular barb portion 402 having a single abutment 404 thereon for engagement with a bead on a metal window frame or sash whereby the retaining clip 396 is especially suited for use with metal windows. Also, it will be noted that the retaining clip 396 is especially suited for use with hollow false muntin members by the provision of a portion 406 extending from the side thereof opposite the triangular portion which is adapted to extend into the end of the hollow false muntin members for securing the hollow false muntin members thereto. The clip 398 also includes a portion 408 extending from one side of the abutment portion 410 adapted to fit within the end of a hollow false muntin member, while the structure 410 provided on the clip 398 to secure the retaining clip 398 to window structure is the same as that provided in the retaining clip 390.

Any of the retaining clips 374, 390, 396 and 398 are suitable for use with the window structure 10. As pointed out above, the retaining clip 394 is more suited for use with wood window structure.

The storm sash 420 provided with the universal window structure 10 and particularly illustrated in FIGS. 85 through 94 is adapted to be secured to the window structure 10 piggyback fashion. Thus, the storm sash 420 does not require separate frame structure and the like and does not alter the appearance of the prime window structure 10. In addition, the storm sash 420 is particularly simple in construction and therefore economical while being especially efficient in use.

The storm sash 420 includes the storm glazing panel 422 and the dual durometer plastic strip 424. the plastic strip is applied to the storm glazing panel 422 around the periphery thereof and the assembled storm glazing panel and plastic strip are secured in the prime window structure 10 in piggyback fashion.

As shown better in FIG. 85, the plastic strip 424 includes the relatively hard U-shaped cross section portion 426 into which the edge of the storm glazing panel 422 is inserted and the relatively soft barb portions 428 for retaining the storm glazing panel 422 and the plastic strip 424 in assembly. The plastic strip 424 further includes the relatively soft sealing flange 430 for sealing between the storm sash 420 and the glazing strip 56, as shown best in FIG. 84.

The plastic strip 424 further includes the relatively hard cross section portion 432 extending generally arcuately from the bottom of the U-shaped portion of the cross section of the plastic strip and terminating in an L-shaped cross section part 434 adapted to fit within the recess 73 in the window sash 54 and around bead 438 as shown in FIG. 84 to retain the storm sash 420 in assembly with the prime window sash 54 without separate retainer clips.

The modified storm sash 440 illustrated in FIG. 86 besides the glazing panel 422 includes a modified dual durometer hardness plastic strip 444 which is better shown in FIG. 87 in perspective. A retaining clip 446 better shown in FIG. 88 is used for retaining the assembled glazing panel 422 and plastic strip 444 on the prime window structure 10.

The plastic strip 444 again includes the rigid U-shaped cross section portion 448 and the relatively flexible barb portions 450 for receiving and holding the periphery of the glazing panel 422 respectively. The sealing flange 452 is again provided to seal between the storm sash 440 and the glazing strip 56 and is of softer plastic than the relatively hard U-shaped portion 448 of the strip 444. A longitudinally extending rib 482 is provided on the rigid U-shaped cross section portion 448 as shown in FIG. 87 to facilitate removal of strip 444 and use of the retaining clips 446 and 470.

The retaining clip 446 is substantially S-shaped in cross section and is provided with the longitudinally extending foot portion 454 and the flange portion 456. In assembly, the foot portion 454 of the clip 446 is received in the recess 73 in the prime window sash with the bead 438 between the foot portion 454 and the flange portion 456 of the clip 446, as shown in FIG. 86. The retaining clip 446 which is of relatively rigid plastic may be of any desired length to provide the required holding force on the storm sash structure 440.

The prime window structure and the glazing panel and plastic strip of the storm sash jamb section illustrated in FIG. 89 are the same as those illustrated in FIG. 86. However, the retaining clip 460 as illustrated in FIG. 90 includes a pivot head 462, a transition portion 464, a retaining portion 466 and a camming portion 468. In use, the pivot head 462 of the retaining clip 460 is positioned in the recess 73 in the prime window sash 54 and the retaining portion 466 together with the transition portion 464 is rotated about the pivot head 462 until the cam portion 468 snaps over the bead 438 of the sash jamb to lock the storm sash in position on the prime sash.

Similarly, the storm glazing panels and plastic strips illustrated in FIGS. 91 and 93 are the same as those illustrated in FIGS. 86 and 89. However, the retaining clip illustrated in FIG. 92 has been used to mount the storm glazing panel and plastic strip in piggyback fashion on the prime window sash 54 as shown in FIG. 91, while the retaining clip illustrated in FIG. 94 has been used to secure the storm glazing panel and peripheral plastic strip on the prime window sash 54 as illustrated in FIG. 93.

The retaining clip 470 illustrated in FIG. 92 includes the tabs 472 and 474 at the opposite ends thereof and the body portion 476 located centrally thereof and in spaced relation to the tabs 472 and 474, which body portion has the toe portion 478 at the end thereof. A camming portion 480 is provided centrally of the body portion of the retaining clip 470 cooperable with rib 482 of strip 444 to retain the clip 470 in assembly with the strip 444 as shown in FIG. 91.

In assembly as shown in FIG. 91, the relatively thin tabs 472 and 474 are inserted between the U-shaped portion 448 of the plastic strip 444 and the storm glazing panel 422 on movement of the clip 470 to cam the camming portion 480 of the clip over the rib 482 until the toe portion 478 of the clip snaps over the bead 438 on the sash to lock the clip in position as shown in FIG. 91.

With such construction, the camming portion 480 tends to apply pressure to hold the toe portion 478 against bead 438 when removal of the clip 470 is attempted. Physical bending of the plastic clip 470 is thus necessary to remove the storm sash received thereby.

The retaining clip 472 includes the elongated bar portion 486 having longitudinal groove 498 therein and terminates in the end portions 488 and 490 extending at right angles thereto and the foot portion 492 extending in the same direction as the end portions 488 and 490 of the bar portion. The retaining portion 494 of retaining clip 472 extends at right angles to the foot portion and includes the bead 496 thereon, as shown in FIG. 94.

In use, the foot portion 492 and the end portions 488 and 490 of the bar portion 486 and the bar portion 486 are inserted in the recess 73 in the prime sash 54, as shown best in FIG. 93, with bead 438 in groove 498. The elongated bar portion 486 permits flexing of the clip 472 in the recess 73 to engage or disengage the clip from the bead 438 to remove the clip 472 from the recess 73 when it is desired to remove the clip. Thus, the clip 472 has the particular advantage of self storing in the recess 73.

Furthermore, with the clip 472 at one extreme of the movement thereof in the recess 73, the storm sash may be removed from the window structure 10 without removing the clip 472. Loss of the clips on inserting and removing the storm sash when the clips 472 are used is therefore not likely.

When the window structure 10 is installed in a window opening in building construction, the trim structure 520 illustrated in FIGS. 95 through 105 may be used in conjunction therewith to provide a finished window opening.

The specific window trim structure 520 particularly illustrated in FIG. 95 includes the trim members 522 and 524 illustrated in enlarged cross section in FIGS. 96 and 97 respectively.

As shown, the member 522 which may be of plastic material has a U-shaped portion 526 including the legs 528 and 530 adapted to receive the edge of a plywood trim panel 532 therebetween as illustrated particularly in FIG. 95. Leg 528 includes the return bent portion 534 which operates to resiliently urge the trim panel 532 away from the stud 538 forming window opening 536 in conjunction with the interior wall panel 540 and the exterior wall panel 542. The trim member 522 further includes the U-shaped portion 544, one leg of which is formed by the connecting portion of the U-shaped portion 526 and which receives the flange 546 of the window structure 10 in assembly.

The trim member 524 as shown best in FIG. 97 again includes the U-shaped portion 548 having the leg member 550 and the leg member 552 with the return portion 554 thereon, which structure is similar to the U-shaped portion 528 of the trim member 522. The U-shaped portion 548 of the trim member 524 receives the other edge of the trim panel 532. The member 524 further includes the decorative extension 556 which may be secured to the inner wall panel 540 by convenient means such as nails or retaining clips to complete the trim of the installed window structure 10 as illustrated in FIG. 95. The trim members 522 and 524 may be connected as desired at the corners, preferably by mitered joints.

The nailing flange 36 of the window structure 10 is secured to the stud through the exterior wall panel by convenient means such as nails driven therethrough. The nailing flange 36 may of course be covered by exterior siding for the building structure, if desired.

The modified trim structure 558 illustrated in FIG. 98 includes the trim and casing member 560 and the casing expander 562 having the cross sections illustrated in FIG. 98 which are secured to the wall structure 564 which includes stud 566, interior wall panel 568 and exterior wall panel 570 by convenient means such as nails.

Again, the window structure 10 is assembled with the casing expander 562 on placing of the flange 546 of the window structure in the recess 572 provided in the casing expander 562. The window trim and casing member 560 in conjunction with the casing expander 562 permits trim of windows in walls of different thickness with equal facility. The leg 574 of the casing expander is inclined toward the leg 576 thereof prior to insertion of end 578 of the member 560 therein so that the finished trim structure always presents the same tight appearance regardless of slight variations in the dimensions of the trim and casing member 560 and expander 562.

The window trim and casing member 560 may be connected at the corners thereof in a mitered joint as will be understood by those in the art. To facilitate such a mitered joint, a corner clip 580, as particularly shown in FIG. 105, having portions 582 and 584 adapted to be inserted in the areas 586 and 588 in the trim member 560 is provided. Thus, a mitered corner may be provided with a single corner insert 580.

When it is desired to trim a window opening wider than can be accommodated by the casing expander 562, a separate casing expander member 586 illustrated particularly in FIG. 99 may be used in conjunction with the trim member 560 and the expander 562 by inserting the end 588 of the expander 586 in the expander 562 and receiving the end 578 of the trim member 558 in the end 590 of the expander 586.

Two additional modifications of the extruded window trim and casing member 558, that is, 592 and 594, are illustrated in FIGS. 100 and 101. A deluxe, heavier-appearing inside window trim and casing member 596 is illustrated in FIG. 102, while two roll-formed inside window trim and casing members 598 and 600 are illustrated in FIGS. 103 and 104. The members 598 and 600 differ in the provision of the rolled edge 602 on the member 598 and the staked-out intermittent portions 604 on the rolled member 600 for securing the members 598 and 600 within an expander member such as 562 and also serve to center the window trim structure in a window opening. The trim members 592, 594, 596, 598 and 600 are interchangeable with the trim member 558 and may be assembled in mitered corner joints in conjunction with corner brackets similar to corner bracket 580.

The window trim structure 600 illustrated in FIGS. 106 to 111 includes a modified trim and casing member 602 and a modified casing expander member 604 shown in assembly in FIG. 106. The trim and casing member 602 includes the flanges 606 and 608 constructed integrally therewith for securing the corner bracket 610 illustrated in FIGS. 109 to 111 in assembly therewith as shown particularly in FIGS. 107 and 108. Again, the inclined resilient flange 612 which may be cut from the trim and casing member 602 centers the trim and casing member in the window opening 614 during assembly and provides positive contact between the barbed end 616 of the trim and casing member 602 with the notches 618 on the casing expander 604. The casing expander 604 as shown in FIG. 106 is provided with the U-shaped portion 620 for receiving the indicated portion of the frame of the window structure 10. The casing expander 604 further includes the notches 618 along the bottom thereof engageable with the barbed end 616 on the trim and casing member cross section to provide a tight connection between the casing expander 604 and the trim and casing member 602 in window openings of different dimensions.

As shown in FIGS. 109 to 111, the corner bracket 610 includes the reinforcing ribs 622 and beads 624 and is generally L-shaped in configuration so that separate halves 626 and 628 thereof fit within the mitered ends of trim and casing members 602 abutting at the corners of window structure 10 as shown FIGS. in FIGS. 107 and 108. The abutments 630 and 632 are provided on the halves 626 and 628 of the corner bracket 610 and include tapered surfaces 634 adapted to cam over the flanges 606 of trim and casing members 602 so that the abutments 630 and 632 may be positioned in the cooperating notches 636 in the casing members 602 in assembly as shown best in FIG. 107.

It will thus be seen that applicant has provided a particularly simple, economical and efficient window structure capable of universal use as a single hung window, a hopper window or a right or left glider window without alteration. While one embodiment and several modifications of the invention have been disclosed in detail, it will be understood that other modifications and embodiments are contemplated by the inventor. It is the intention to include all embodiments and modifications of the invention as are suggested by the appended claims within the scope of the invention.

What I claim as my invention is:

1. A glazing strip for securing a glazing panel in a window structure or the like, comprising an elongated resilient member having a cross section including a first substantially straight portion, one end of which is independently flexible, the other end of which is adapted to engage a recess in the window frame for securing the glazing strip in the window frame, a second substantially straight portion depending substantially perpendicularly from the one end of the first portion adapted to engage a glazing panel positioned in the window frame for securing the glazing panel in the window frame, and a third substantially straight portion one end of which is connected to the first portion which diverges from the first portion toward the other end of the first portion for securing the glazing strip in the recess in the window frame.

2. Structure as set forth in claim 1 wherein the other end of the first portion and the third portion of the cross section of the glazing strip form an angle of less than 180° therebetween.

3. A glazing strip for securing a glazing panel in a window structure or the like, comprising an elongated resilient member having a cross section having a first substantially straight portion, one end of which is independently flexible, the other end of which is adapted to engage a recess in the window frame for securing the glazing strip in the window frame, a second substantially straight portion depending substantially perpendicularly from the one end of the first portion adapted to engage a glazing panel positioned in the window frame for securing the glazing panel in the window frame, a third substantially straight portion one end of which is connected to the first portion which diverges from the first portion toward the other end of the first portion for securing the glazing strip in the recess in the window frame, and a fourth straight portion extending substantially perpendicularly from said other end of said first portion in the direction of said second portion for aiding in securing the glazing strip in the recess in the window frame.

4. Structure as set forth in claim 3 and further including a fifth portion connected to the first portion adjacent the other end thereof and extending substantially perpendicularly thereto in the direction of the second and fourth portions for engagement with the window pane to flex the first portion to facilitate positioning of the fourth portion of the glazing strip cross section in the window frame recess.

5. A glazing strip for securing a glazing panel in a window structure or the like, comprising an elongated resilient member having a cross section including a first substantially straight portion, one end of which is independently flexible, the other end of which is adapted to engage a recess in the window frame for securing the glazing strip in the window frame, a second substantially straight portion depending substantially perpendicularly from the one end of the first portion adapted to engage a glazing panel positioned in the window frame for securing the glazing panel in the window frame, a third substantially straight portion one end of which is connected to the first portion which diverges from the first portion at the other end of the first portion to form an angle of less than 180° therebetween for securing the glazing strip in the recess in the window frame, and a fourth straight portion extending substantially perpendicularly from said other end of said first portion in the direction of said second portion for aiding in securing the glazing strip in the recess of the window frame.

6. Structure as set forth in claim 5 and further including a fifth portion connected to the first portion adjacent the other end thereof and extending substantially perpendicularly thereto in the direction of the second and fourth portions for engagement with the window pane to flex the first portion to facilitate positioning of the fourth portion of the glazing strip cross section in the window frame recess.

* * * * *